US007410392B2

(12) United States Patent
Szczesny et al.

(10) Patent No.: US 7,410,392 B2
(45) Date of Patent: Aug. 12, 2008

(54) ELECTRICAL CONNECTOR ASSEMBLY HAVING SELECTIVE ARRANGEMENT OF SIGNAL AND GROUND CONTACTS

(75) Inventors: David Stanley Szczesny, Hershey, PA (US); Robert Neil Whiteman, Jr., Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/410,767

(22) Filed: Apr. 26, 2006

(65) Prior Publication Data

US 2007/0141872 A1 Jun. 21, 2007

Related U.S. Application Data

(63) Continuation-in-part of application No. 11/304,235, filed on Dec. 15, 2005.

(51) Int. Cl.
*H01R 13/648* (2006.01)

(52) U.S. Cl. ..... 439/608; 439/680; 439/108

(58) Field of Classification Search ..... 439/108, 439/607–608, 680
See application file for complete search history.

(56) References Cited

U.S. PATENT DOCUMENTS 5,385,490 A * 1/1995 Demeter et al. ..... 439/579
5,716,237 A * 2/1998 Conorich et al. ..... 439/660
6,478,624 B2 * 11/2002 Ramey et al. ..... 439/608
6,561,850 B2 * 5/2003 Letourneau et al. ..... 439/608
6,663,427 B1 * 12/2003 Billman et al. ..... 439/608
6,851,981 B2 * 2/2005 Droesbeke et al. ..... 439/608
2001/0046810 A1 11/2001 Cohen et al
2002/0177334 A1 11/2002 Akama et al.
2004/0242071 A1 12/2004 Ito et al.
2004/0242072 A1 12/2004 Kumamoto et al.

FOREIGN PATENT DOCUMENTS

DE 20 2005 009 919 U1 10/2005
DE 10 2004 060 782 B3 3/2006

* cited by examiner

*Primary Examiner*—Truc T Nguyen

(57) ABSTRACT

An electrical connector assembly includes a housing having an array of compartments, and substantially identical signal contact assemblies arranged in sets, each including a pair of the signal contact assemblies arranged opposite first and second orientations, and selectively installed in a respective pair of compartments. One ground contact may form a signal-signal-ground pattern, while two ground contacts may form a signal-signal-ground-ground pattern. Additionally, an electrical connector assembly includes a housing having at least two substantially identical signal contact assemblies, one in a first orientation, another in a second orientation. At least one recess is formed within the signal contact assembly; and at least one protruding ridge extends from the signal contact assembly. The recesses of the signal contact assembly in the first orientation receive at least one of the protruding ridges in a second orientation. The protruding ridges in the first orientation engage with the recesses in the second orientation.

6 Claims, 20 Drawing Sheets

ELECTRICAL CONNECTOR ASSEMBLY HAVING SELECTIVE ARRANGEMENT OF SIGNAL AND GROUND CONTACTS

CROSS-REFERENCE TO RELATED APPLICATIONS

This application is a continuation-in-part of U.S. patent application Ser. No. 11/304,235 by D. S. Szczesny, filed on 15 Dec. 2005, entitled "ELECTRICAL CONTACT ASSEMBLY AND METHOD OF MANUFACTURING THEREOF", the entire contents of which are incorporated by reference herein.

BACKGROUND

1. Technical Field

The present disclosure relates to electrical connector assemblies and, more particularly, to an electrical connector assembly having an array of signal and ground contacts.

2. Discussion of Related Art

Electrical connectors for applications such as mating to an edge of a printed circuit board must contain numerous electrical contacts. Cost is increased when an electrical connector must have several different types of contacts, including several types of signal and ground contacts, as each type of contact must be separately manufactured, thereby requiring different part numbers, different tooling, and separate stocking requirements. Further, the need for similar connectors having different contact arrangements also adds complexity to shipping, manufacturing and stocking or inventory requirements.

There is a need for an electrical connector assembly having signal and ground contacts which is economical to manufacture and to assemble.

SUMMARY

The present disclosure relates to a single signal contact assembly which may be used either with or without a ground contact to permit a signal-signal-ground (S-S-G) pattern or a signal-signal-ground-ground (S-S-G-G) pattern, or a signal-signal (S-S) pattern to reduce overall manufacturing and inventory costs The present disclosure relates to a single signal contact assembly which enables a contact tail portion of a ground contact to reside in recesses in the signal contact assembly to provide additional flexibility in arrangement of an electrical connector assembly.

The present disclosure relates to an electrical connector assembly having signal and ground contacts which is economical to manufacture and to assemble. More particularly, the present disclosure relates to an electrical connector assembly which includes a housing having an array of compartments. The housing holds a plurality of signal contact assemblies arranged in sets wherein each set includes a pair of identical signal contact assemblies arranged in opposite first and second orientations and the housing also holds a plurality of identical ground contacts which can be selectively installed in the compartments between the sets of identical signal contacts, with each of the sets being installed in a respective pair of the compartments. One ground contact may be installed between each of the sets of identical signal contacts to form a signal-signal-ground pattern. Each of the signal contact assemblies may include an insulative carrier, and each of the ground contacts is closely supported by the insulative carrier of an adjacent said signal contact assembly.

Two ground contacts may be installed between each of the sets to form a signal-signal-ground-ground pattern.

The present disclosure relates also to an electrical connector assembly which includes a housing having an array of compartments, with the housing holding a plurality of signal contact assemblies arranged in sets. Each set includes a pair of identical signal contact assemblies arranged in opposite first and second orientations wherein the plurality of signal contact assemblies arranged in sets are selectively installed in the compartments to form a signal-signal pattern.

In yet another illustrative aspect, the present disclosure relates to an electrical connector assembly which includes a housing having at least two substantially identical signal contact assemblies. The contact assemblies include a signal contact assembly in a first orientation which includes at least one recess formed within the signal contact assembly, and at least one protruding ridge extending from the signal contact assembly; and a signal contact assembly in a second orientation which also includes at least one recess formed within the signal contact assembly, and at least one protruding ridge extending from the signal contact assembly. The recess of the signal contact assembly in the first orientation is disposed on the signal contact assembly in the first orientation to enable reception of the protruding ridge of the substantially identical signal contact assembly in the second orientation, and the protruding ridge of the signal contact assembly in the first orientation is disposed on the signal contact assembly in the first orientation to enable engagement with the recess disposed on the substantially identical signal contact assembly in the second orientation. The housing may further include at least one ground contact disposed between the signal contact assembly in the first orientation and the signal contact assembly in the second orientation. Both the signal contact assembly in the first orientation and the signal contact assembly in the second orientation may further include first and second signal contacts each having an edge connector portion, and a contact tail portion in electrical communication with the edge connector portion. A carrier holds the first signal contact and the second signal contact, with the carrier having the recess and the at least one protruding ridge. The edge connector portion of the first signal contact may be substantially a mirror image of the edge connector portion of the second signal contact, and the contact tail portion of the first signal contact is substantially a slide-along image of the contact tail portion of the second signal contact. The first and second signal contacts may each include a contact beam portion extending from the edge connector portion, with the contact beam portion providing the electrical communication between the edge connector portion and the contact tail portion. The contact beam portion of the first signal contact may be substantially a mirror image of the contact beam portion of the second signal contact.

In yet another embodiment, the present disclosure relates to an electrical connector assembly which includes a housing having a signal contact assembly in a first orientation, and a signal contact assembly in a second orientation which is reverse to the first orientation. A recess is disposed in the signal contact assembly in a first orientation such that the recess enables reception of a contact tail portion of a ground contact and such that the recess can be substantially aligned with a recess disposed on the signal contact assembly in a second orientation. The ground contact may include a joining portion partially forming a substantially planar first surface, and a contact tail portion disposed at an angle to the first surface, with the contact tail portion having a signal contact assembly mating portion. When the first surface of the ground contact is in opposing relationship with a first surface of the signal contact assembly in the first orientation, the signal contact assembly mating portion resides in the recess of the contact assembly which is in the first orientation. Furthermore, when the recess of the contact assembly which is in the second orientation is substantially aligned with the recess of the contact assembly which is in the first orientation, the signal contact assembly mating portion may further reside in the recess of the contact assembly which is in the second orientation.

DETAILED DESCRIPTION

Figure 1:
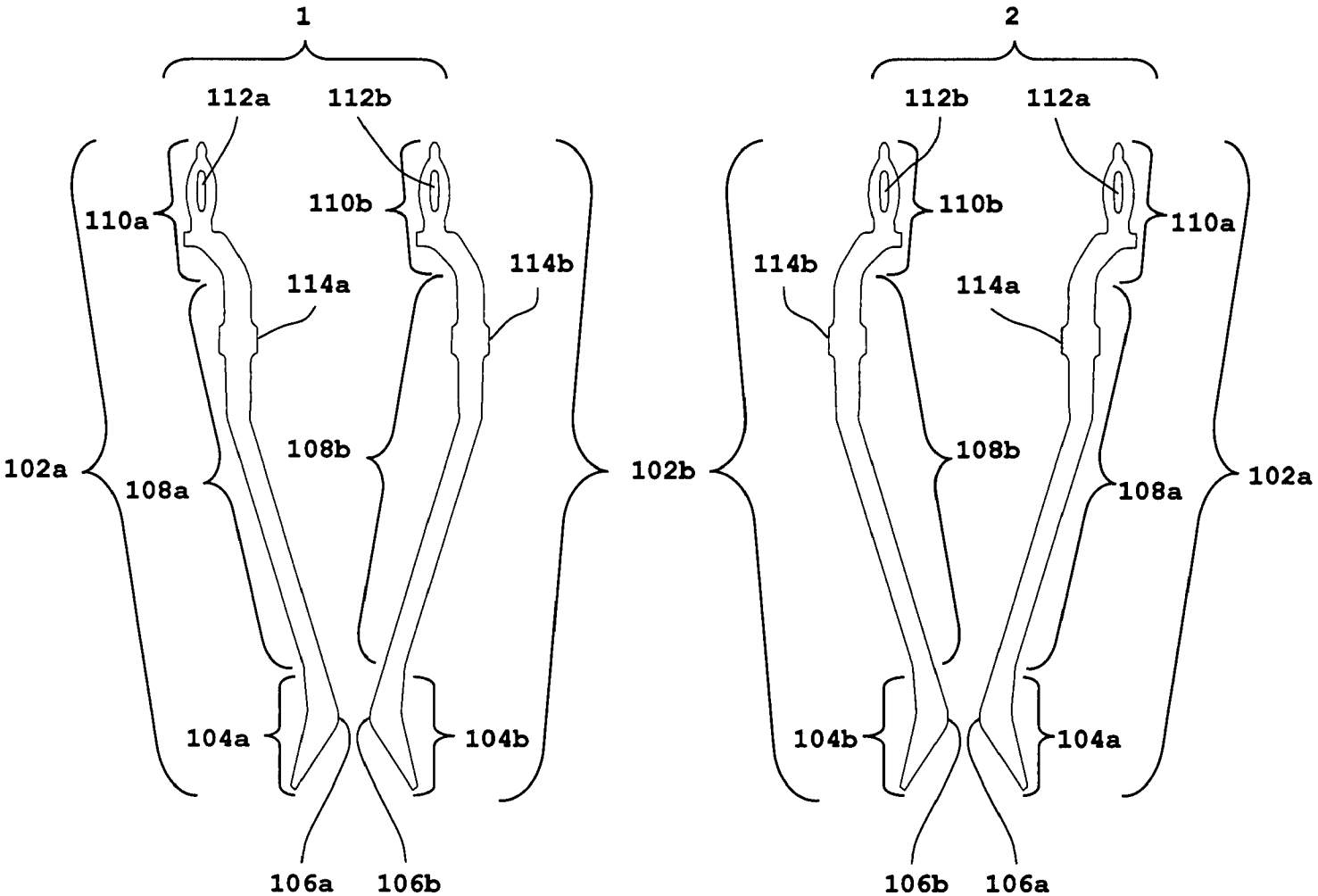
FIG. 1 is a side view of two pairs of electrical contacts for a set of electrical contact assemblies according to the present disclosure.

The present disclosure will be understood more fully from the detailed description given below and from the accompanying drawings of particular embodiments of the disclosure which, however, should not be taken to limit the disclosure to a specific embodiment but are for explanatory purposes.

Numerous specific details may be set forth herein to provide a thorough understanding of a number of possible embodiments of the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Embodiments of the presently disclosed electrical connector will now be described in detail with reference to the drawing figures wherein like reference numerals identify similar or identical elements. As used herein and as is traditional, the term "distal" refers to that portion which is furthest from the user or from a designated structure while the term "proximal" refers to that portion which is closest to the user or to a designated structure. In addition, terms such as "above", "below", "forward", "rearward", "bottom", "top", etc. refer to the orientation of the figures or the direction of components and are simply used for convenience of description.

Figure 2:
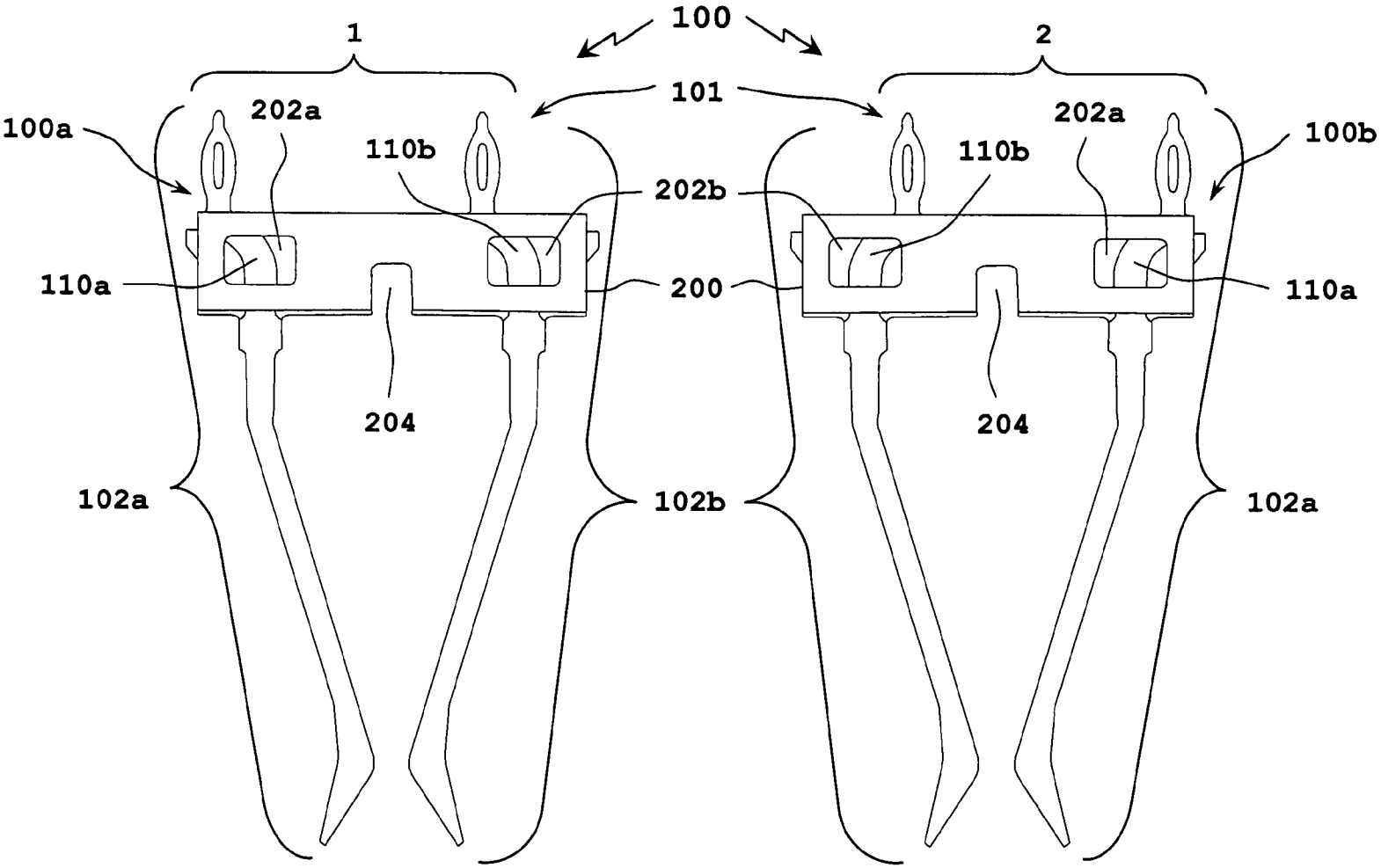
FIG. 2 is a side view of a set of two electrical contact assemblies according to the present disclosure.
Figure 3:
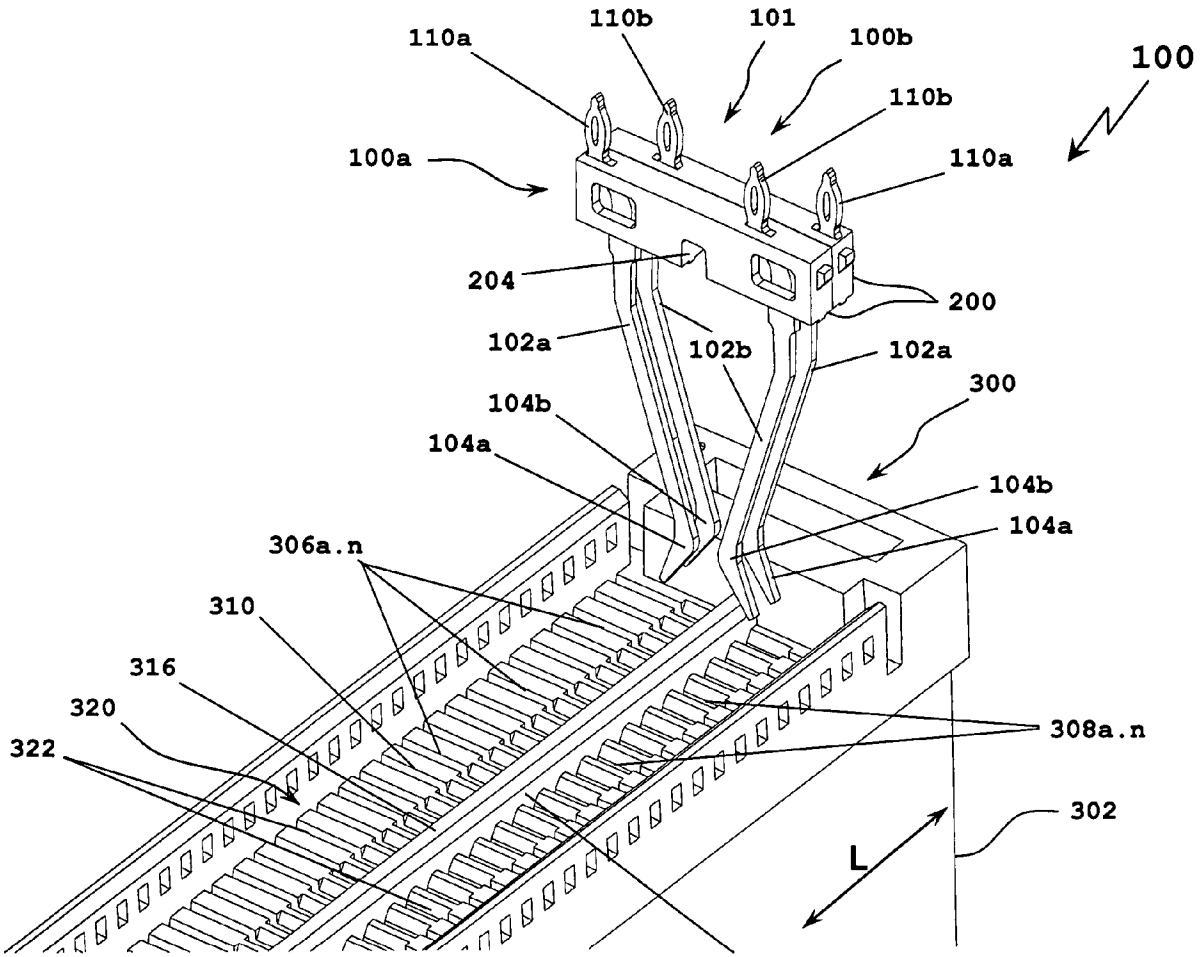
FIG. 3 is a perspective view of a set of electrical contact assemblies being inserted into an electrical connector assembly according to one embodiment of the present disclosure.
Figure 4:
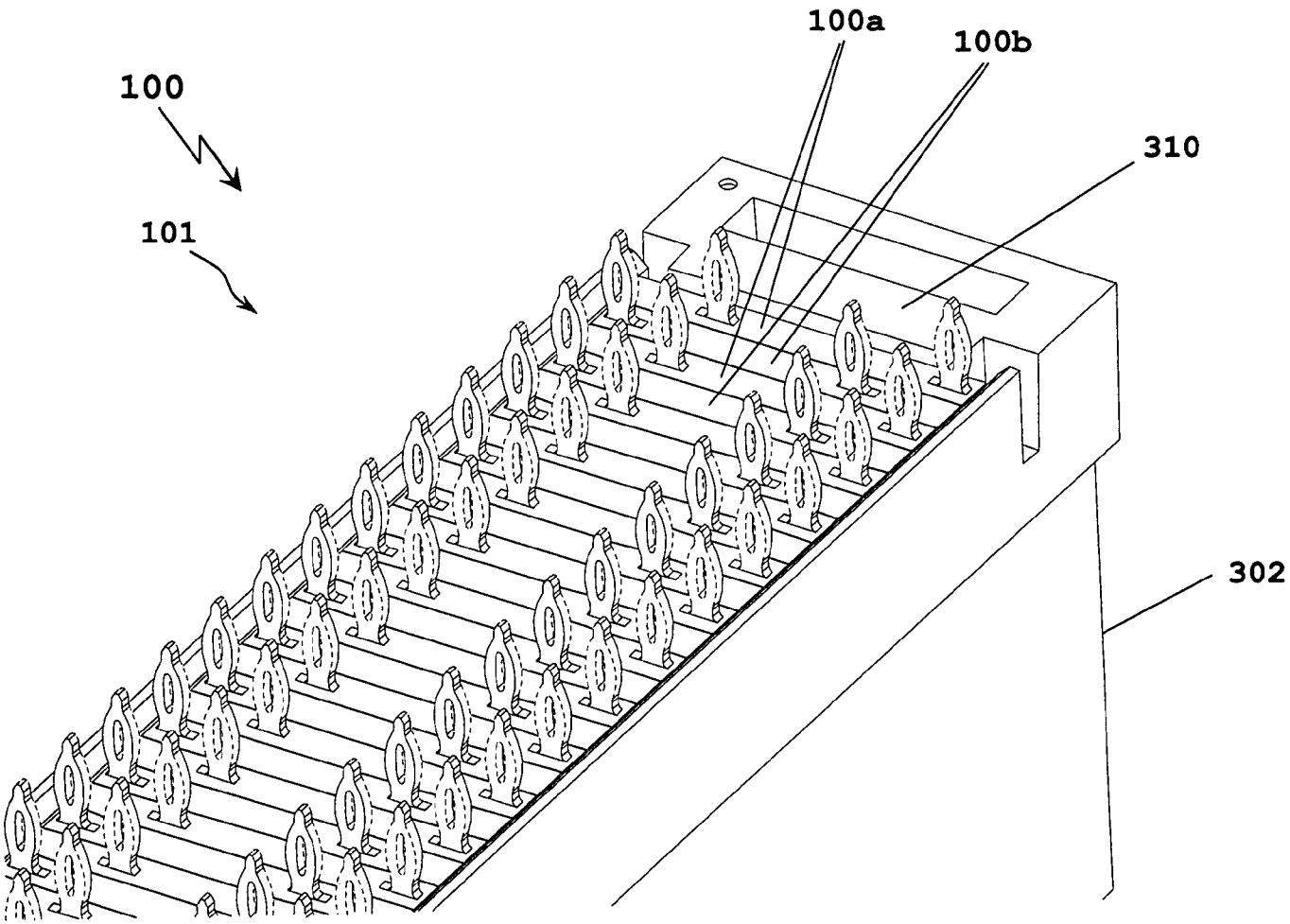
FIG. 4 is an enlarged partial perspective view of the electrical contact assemblies installed in the electrical connector assembly according to one embodiment of the present disclosure.
Figure 5:
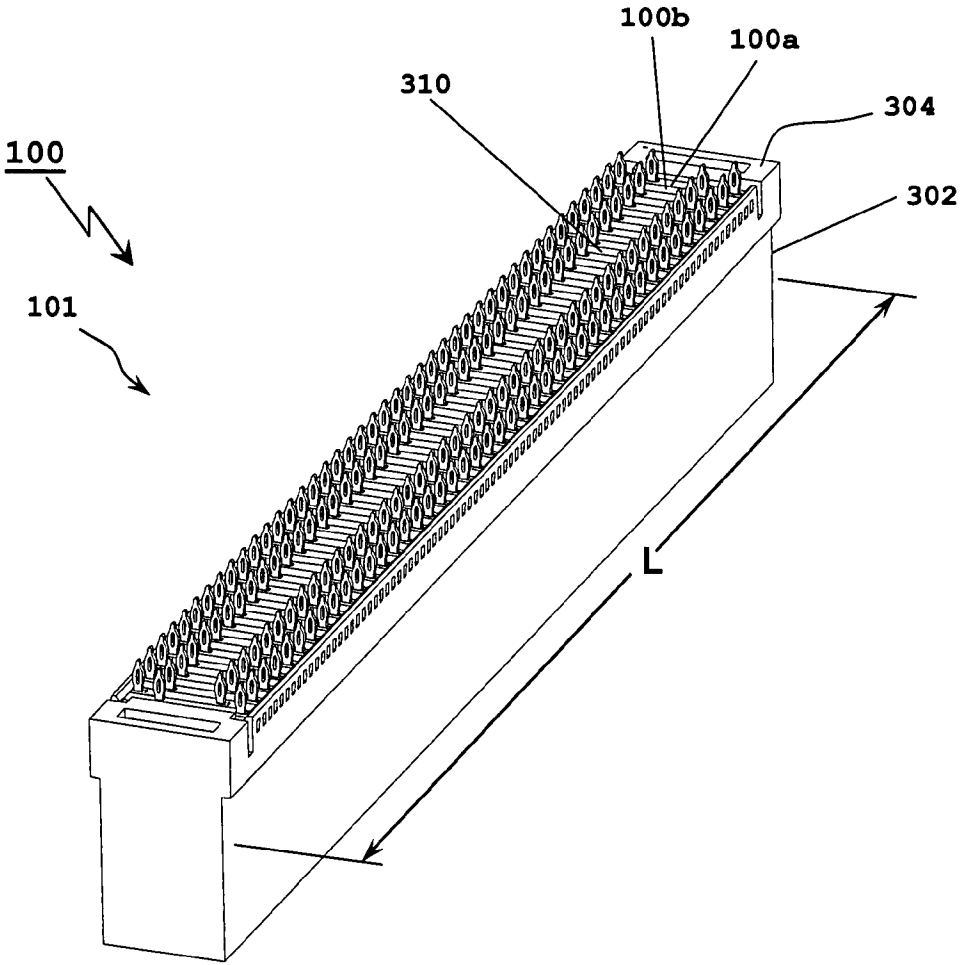
FIG. 5 is full perspective view of the electrical contact assemblies installed in the electrical connector assembly as illustrated in FIG. 4.
Figure 6:
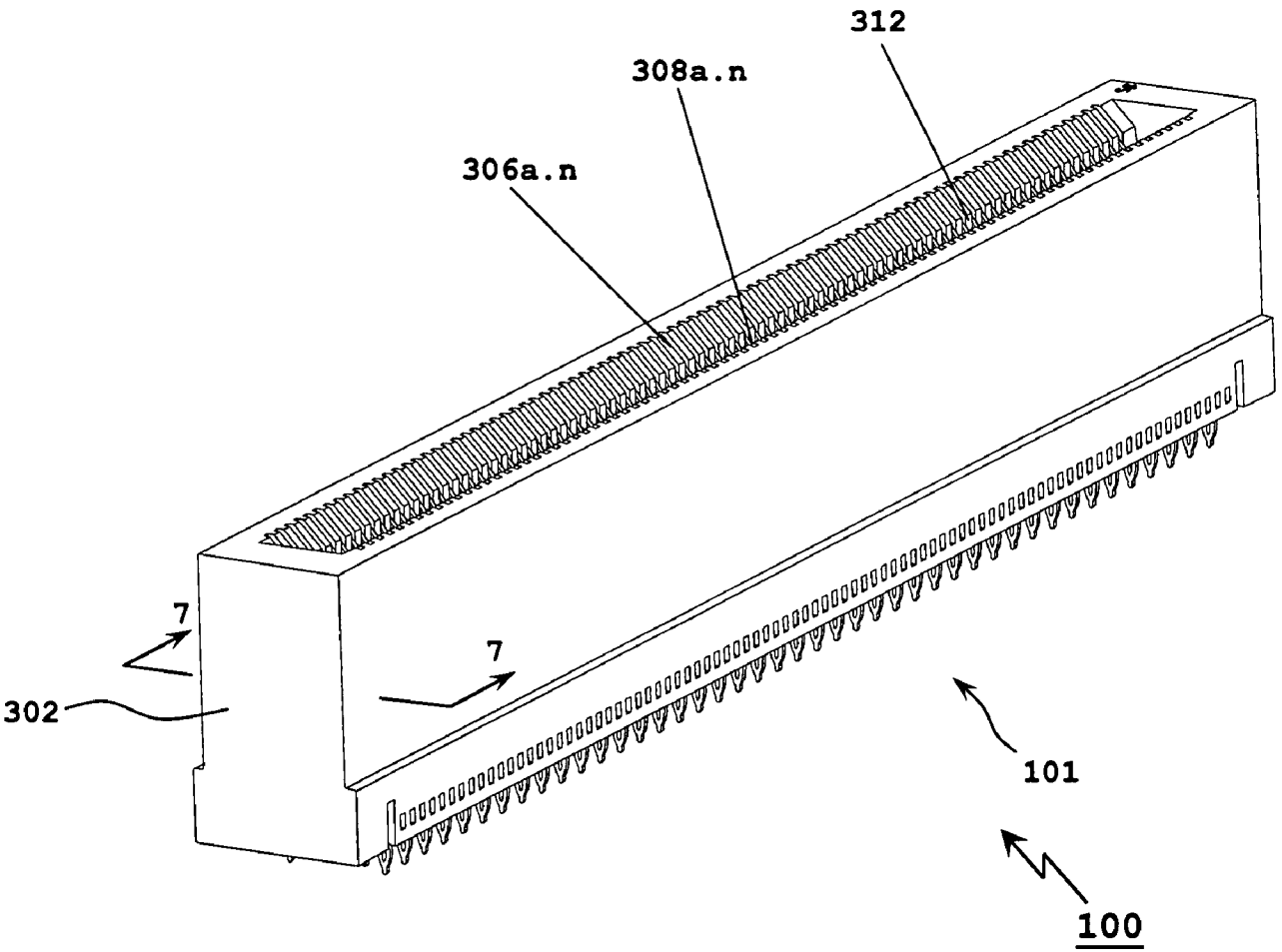
FIG. 6 is a perspective view of the electrical contact assemblies installed in the electrical connector assembly according to one embodiment of the present disclosure.
Figure 7:
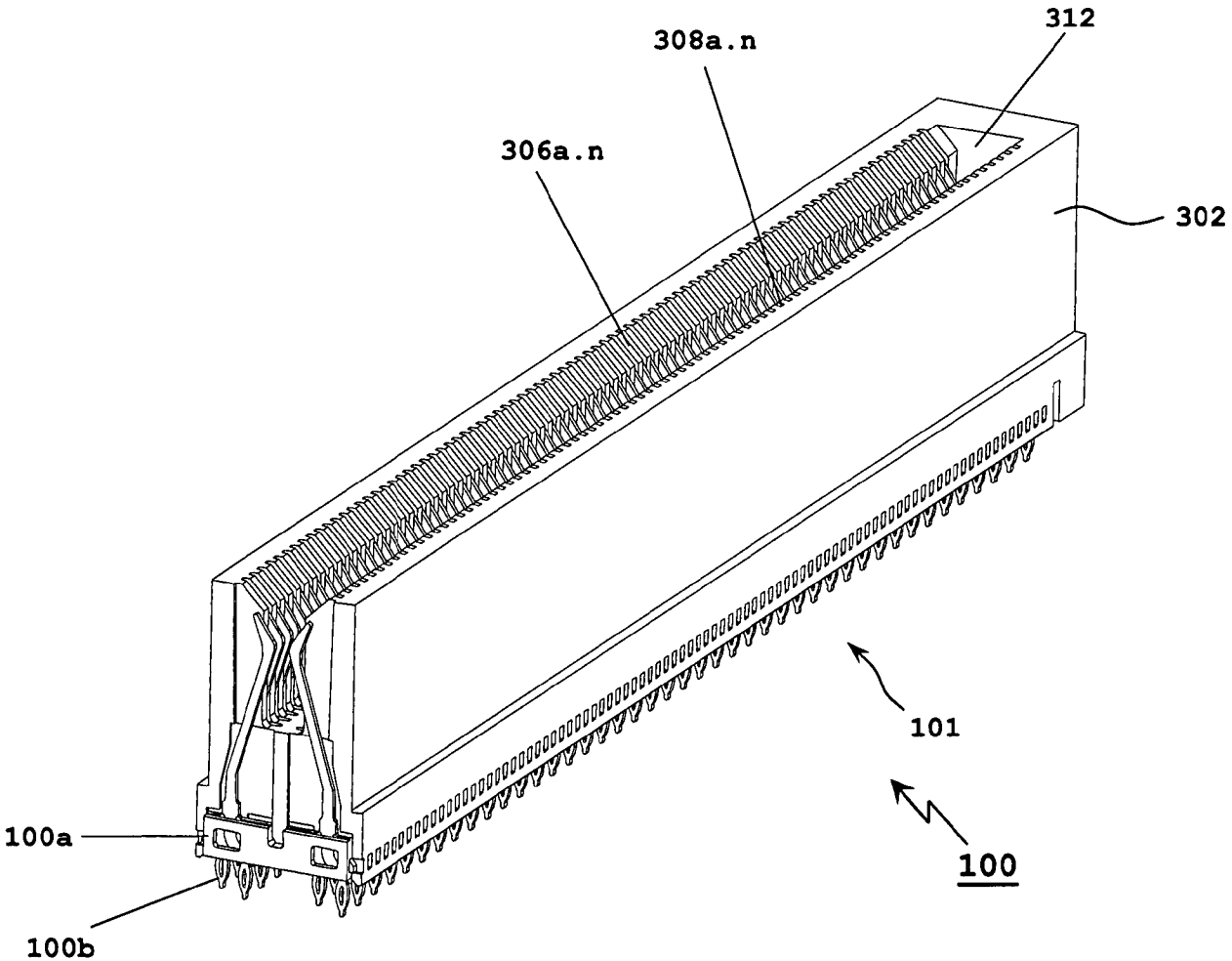
FIG. 7 is a perspective view of the end of the electrical connector assembly showing the electrical contact assemblies taken along cross-section line 7-7 of FIG. 6.

Referring to FIGS. 1-6, a plurality of sets 101 of substantially identical electrical contact assemblies according to an embodiment of the present disclosure are generally designated as 100. Each set 101 of electrical contact assemblies 100 includes a first pair 1 having a first electrical contact 102*a* and a second electrical contact 102*b*. The first pair 1 is arranged in a first orientation 100*a*. Each set 101 of substantially identical electrical contact assemblies 100 further includes a second pair 2 also having first electrical contact 102*a* and second electrical contact 102*b*. The second pair 2 is arranged in a second orientation 100*b*. As illustrated in FIGS. 1 and 2, the first pair 1 is arranged as a mirror image of the second pair 2. More particularly, the first pair 1 and the second pair 2 are rotated with respect to each other so that the orientation 100*b* of the second pair 2 is a reverse orientation with respect to the orientation 100*a* of the first pair 1.

The first and second electrical contacts 102*a* and 102*b* each include an edge connector portion 104*a*, 104*b* having a contact surface 106*a*, 106*b*, respectively. The first and second electrical contacts 102*a*, 102*b* each include a contact tail portion 110*a*, 110*b*, respectively. The contact tail portions 110*a* and 110*b* may also be referred to in the art as board mounting ends or through hole tails. The contact tail portion 110*a*, 110*b* is in electrical communication with the edge connector portion 104*a*, 104*b*, respectively. The first and second electrical contacts 102*a*, 102*b* may each include a contact beam portion 108*a*, 108*b* which may be predominantly linear and which extends from the edge connector portion 104*a*, 104*b* to the contact tail portion 110*a*, 110*b*, respectively. A manufacturing cut-off region 114*a*, 114*b* may be included within the contact beam portion 108*a*, 108*b*, respectively. The contact beam portion 108*a*, 108*b* is in electrical communication with the edge connector portion 104*a*, 104*b* and with the contact tail portion 110*a*, 110*b*.

The contact tail portions 110*a*, 110*b* are illustrated in FIG. 1 as compliant or press fit tail portions each of which has an aperture 112*a*, 112*b* disposed therethrough, respectively, which is compressed during insertion into a receptacle (not shown) of a printed circuit board (PCB) or other electrical device to establish electrical continuity with the PCB or other electrical device. Alternatively, the contact tail portions 110*a*, 110*b* may be formed as card edge contacts or pin or post contacts, or the like. The embodiments are not limited in this context.

The edge connector portion 104*a* of the first electrical contact 102*a* is substantially a mirror image of the edge connector portion 104*b* of the second electrical contact 102*b*. Similarly, the contact beam portion 108*a* of the first electrical contact 102*a* is substantially a mirror image of the contact beam portion 108*b* of the second electrical contact 102*b*. However, the contact tail portion 110*a* of the first electrical contact 102*a* is substantially a slide-along image of the contact tail portion 110*b* of the second electrical contact 102*b*.

The first and second electrical contacts 102*a* and 102*b*, respectively, are made from an electrically conductive material, e.g., copper or a copper alloy. The embodiments are not limited in this context.

The electrical contact assembly 100 further includes an insulative carrier 200 which holds the first electrical contact 102*a* and the second electrical contact 102*b* such that the contact tail portion 110*a* of the first electrical contact 102*a* is oriented substantially as a slide-along image of the contact tail portion 110*b* of the second electrical contact 102*b*.

In one embodiment, the carrier 200 holds the contact beam portion 108*a* of the first electrical contact 102*a* and the contact beam portion 108*b* of the second electrical contact 102*b* such that the contact tail portion 110*a* of the first electrical contact 102*a* is oriented substantially as a slide-along image of the contact tail portion 110*b* of the second electrical contact 102*b*. The carrier 200 may be a structural member such as an overmolding which may be made from an electrically insulating material such as a plastic, and which enables electrical insulation between the first and second electrical contacts 102*a* and 102*b*, respectively. The embodiments are not limited in this context.

The carrier 200 is configured such that the contact tail portions 110*a*, 110*b* are exposed thereby. In one embodiment, the carrier 200 may further include a recess 204 for mating to a surface of a housing of an electrical connector as discussed below. In addition, the overmolding or carrier 200 may further include at least one aperture, and typically at least two apertures 202*a*, 202*b*, disposed therethrough so as to expose at least a portion of the contact beam portions 108*a* and 108*b*, respectively.

As illustrated in FIGS. 3-7, the present disclosure relates also to an electrical connector or electrical connector assembly 300 including a housing 302. The housing 302 includes bottom and top apertures 310 and 312 providing accessibility to an array 320 of compartments 322. The housing 302 is configured to receive at least one set 101 of the substantially identical electrical contact assemblies 100 via the array 320 of partitioned electrically insulating adjacent compartments 322. The array 320 of partitioned compartments is subdivided into a first array 306*a* . . . *n* and a second array 308*a* . . . *n* which are electrically and mechanically separated from each other via a wall or partition 314 disposed substantially centrally along a length L of the housing 302, where "a" equals one and "n" equals a number greater than one. The wall or partition 314 includes a ridge or saddle member 316 also disposed substantially centrally along the length L. The recess 204 of the overmolding 200 engages with the ridge or saddle member 316 to provide a degree of stability for the electrical contact assemblies 100 when the electrical contact assemblies 100 are received by the housing 302.

The compartments 322 of the array 320 are configured to expose the contact tail portions 110*a*, 110*b* of the first and second electrical contacts 102*a*, 102*b* at the first aperture 310. As illustrated particularly in FIGS. 3-7, a plurality of contact assemblies 100 are arranged in sets 101 in sequence in a linear array such that the electrical contacts 102*a*, 102*b* of the plurality of contact assemblies 100 are arranged in the second orientation 100*b* which is a reverse orientation with respect to the first orientation 100*a* of an immediately preceding contact assembly 100 so as to expose the contact tail portions 110*a*, 110*b* of the electrical contact assemblies 100 in a staggered configuration with respect to the contact tail portions 110*b*, 110*a* of the immediately preceding contact assembly, respectively. The compartments 322 of the array 320 are configured to expose the edge connector portions 104*a*, 104*b* of the first and second electrical contacts 102*a*, 102*b* at the top aperture 312.

As a result of the foregoing, the electrical connector assembly 300 includes the housing 302, and at least one set 101 of substantially identical contact assemblies 100. In one embodiment, the housing 302 includes a plurality of the substantially identical contact assemblies 100. Each contact assembly 100 includes at least one of the pairs 1 or 2 of electrical contacts 102*a*, 102*b* having the contact tail portions 110*a*, 110*b*. The plurality of contact assemblies 100 are arranged in sequence in a linear array in the housing 302. Each contact assembly 100 is arranged in the sequence in alternating first and second orientations 100*a*, 100*b*, respectively. The second orientation 100*b* is a reverse orientation with respect to the first orientation 100*a*.

Furthermore, the electrical connector assembly 300 includes the housing 302 holding a plurality of the sets 101 of identical contact assemblies 100 arranged in a linear array and in a reverse alternating sequence such that each successive contact assembly 100 in the array has a reverse orientation 100*b* with respect to an orientation 100*a* of an immediately preceding contact assembly 100.

Figure 8:
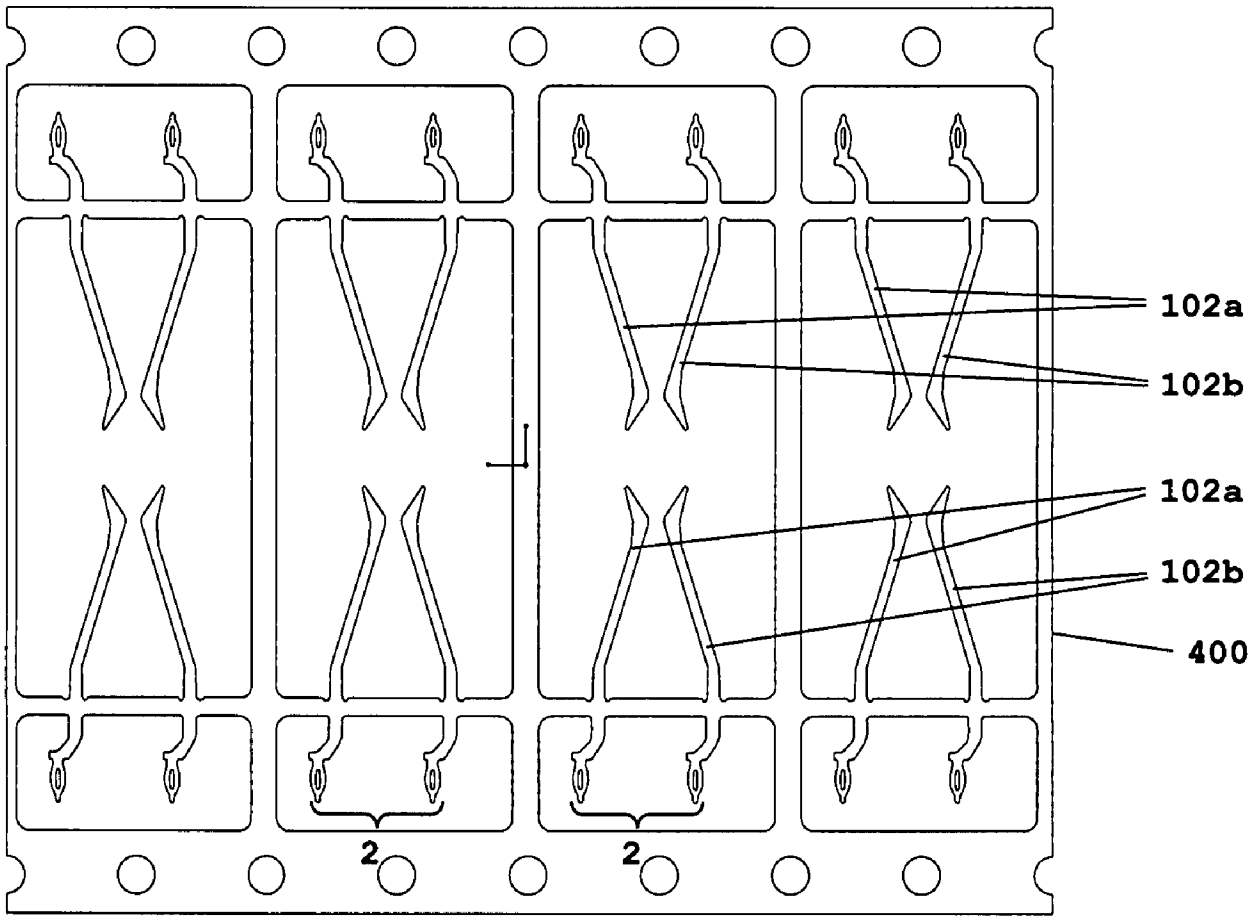
FIG. 8 is a plan view of a carrier strip during a portion of a manufacturing method for manufacturing multiple pairs of electrical contact assemblies according to one embodiment of the present disclosure.
Figure 9:
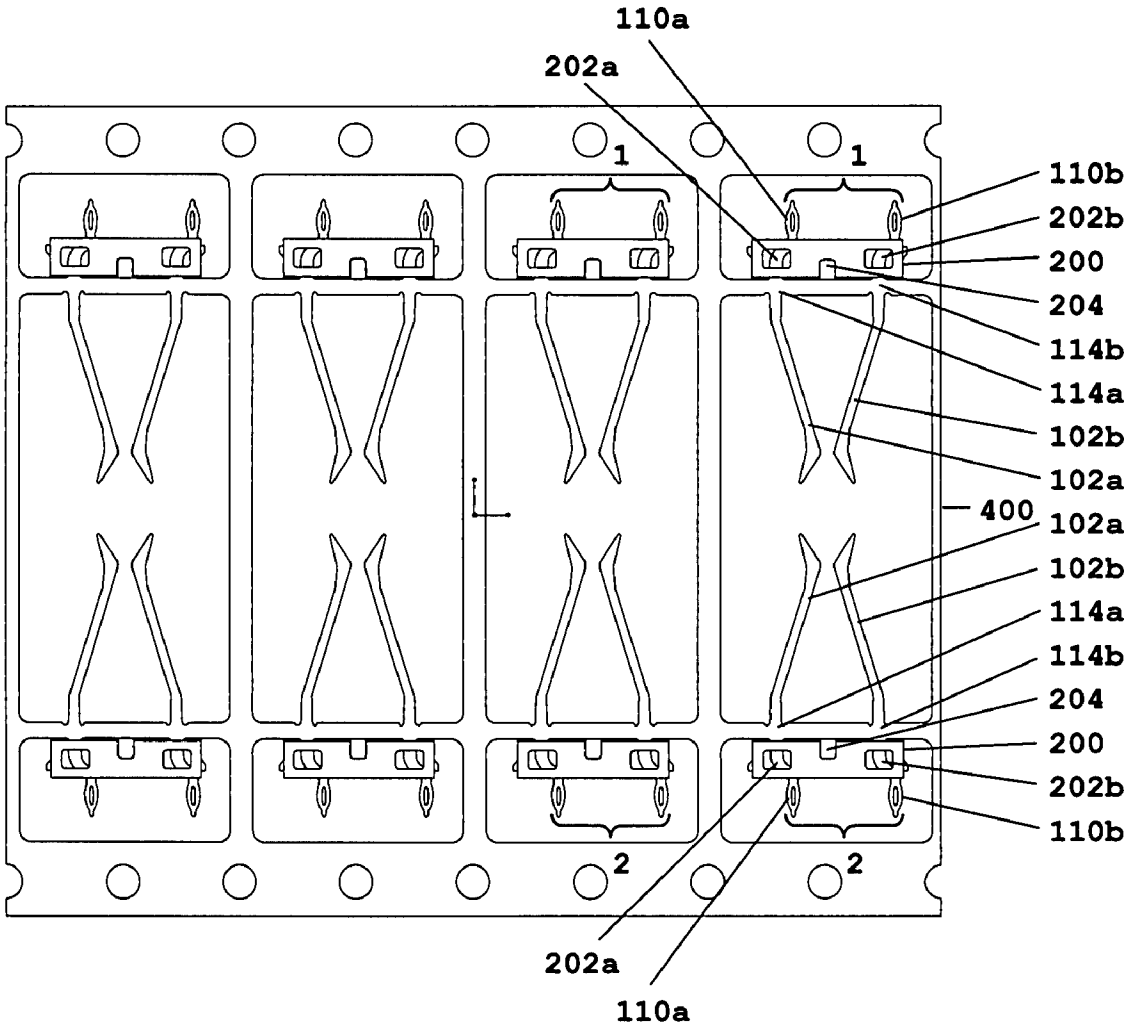
FIG. 9 is a plan view of the carrier strip during another portion of a manufacturing method for manufacturing multiple pairs of electrical contact assemblies according to one embodiment of the present disclosure.

FIGS. 8-9 disclose a method of manufacturing the electrical contact assembly 100. In particular, as illustrated in FIG. 8, the method includes the steps of providing a carrier strip 400, and stamping the carrier strip 400 to form at least a first electrical contact assembly 100. In one embodiment, the step of stamping the carrier strip is implemented by forming a multiplicity of the electrical contact assemblies 100. Each electrical contact assembly 100 includes first electrical contact 102*a* and second electrical contact 102*b*. The first electrical contact 102*a* is configured so that contact tail portion 110*a* is in electrical communication with the edge connector portion 104*a* (shown in FIG. 1). Similarly, the second electrical contact 102*b* is configured so that contact tail portion 110*b* is in electrical communication with the edge connector portion 104*b*. The first and second electrical contacts 102*a* and 102*b* are made from an electrically conductive material to provide electrical communication between the edge connector portions 104*a*, 104*b* and the contact tail portions 110*a*, 110*b*, respectively.

The edge connector portion 104*a* of the first electrical contact 102*a* is substantially a mirror image of the edge connector portion 104*b* of the second electrical contact 102*b*, while the contact tail portion 110*a* of the first electrical contact 102*a* is substantially a slide-along image of the contact tail portion 110*b* of the second electrical contact 102*b*. In one embodiment of the method, the first and second electrical contacts 102*a* and 102*b*, respectively, each include a contact beam portion 108*a* and 108*b* (shown in FIG. 1), respectively, extending from the edge connector portion 104*a*, 104*b*, respectively. The contact beam portion 108*a*, 108*b* may provide the electrical communication between the edge connector portion 104*a*, 104*b* and the contact tail portion 110*a*, 110*b*, respectively. The contact beam portion 108*a* of the first electrical contact 102*a* may be substantially a mirror image of the contact beam portion 108*b* of the second electrical contact 102*b*.

The method of manufacturing may further include the step of joining the first electrical contact 102*a* together with the second electrical contact 102*b* to form an electrical contact assembly 100. In one embodiment, the step of joining the first electrical contact 102*a* together with the second electrical contact 102*b* is implemented by forming overmolding the carrier 200 over the first and second electrical contacts 102*a* and 102*b*, respectively. The carrier 200 provides electrical insulation between the first and second electrical contacts 102*a* and 102*b*, respectively. In one embodiment, the method of manufacturing may further include the step of cutting the first electrical contact assembly 100 from the carrier strip 400 via the manufacturing cut-offs 114*a* and 114*b*. The method may further include the step of providing a recess 204 in the carrier 200 for mating to ridge or saddle member 316 of the housing 302. The method of manufacturing may further include the step of providing at least one aperture 202*a*, and typically at least two apertures 202*a* and 202*b* disposed through the carrier 200 so as to expose at least a portion of the contact tail portions 110*a*, 110*b*.

Figure 10:
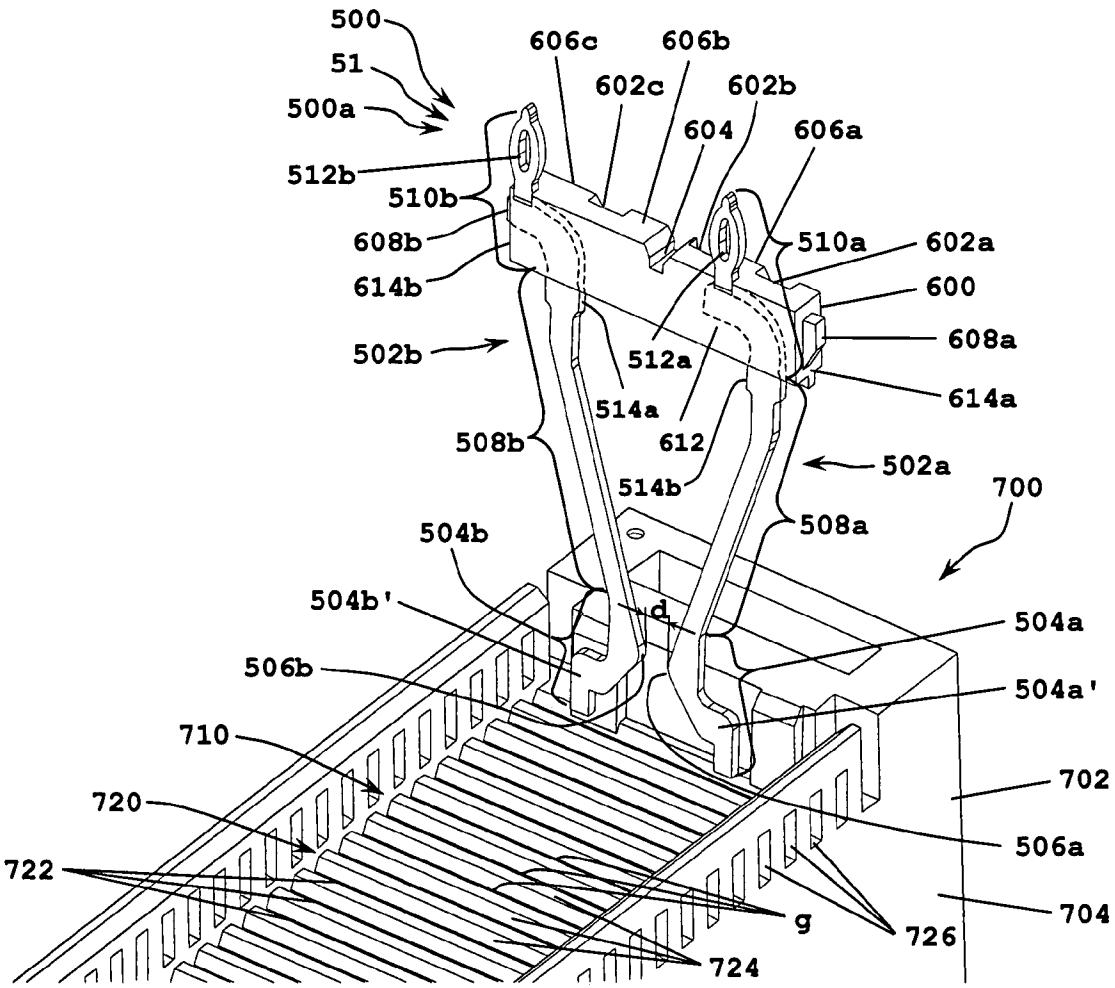
FIG. 10 is a perspective view of a first signal contact assembly in a first orientation being inserted into an electrical connector assembly according to an alternate embodiment of the present disclosure.
Figure 11:
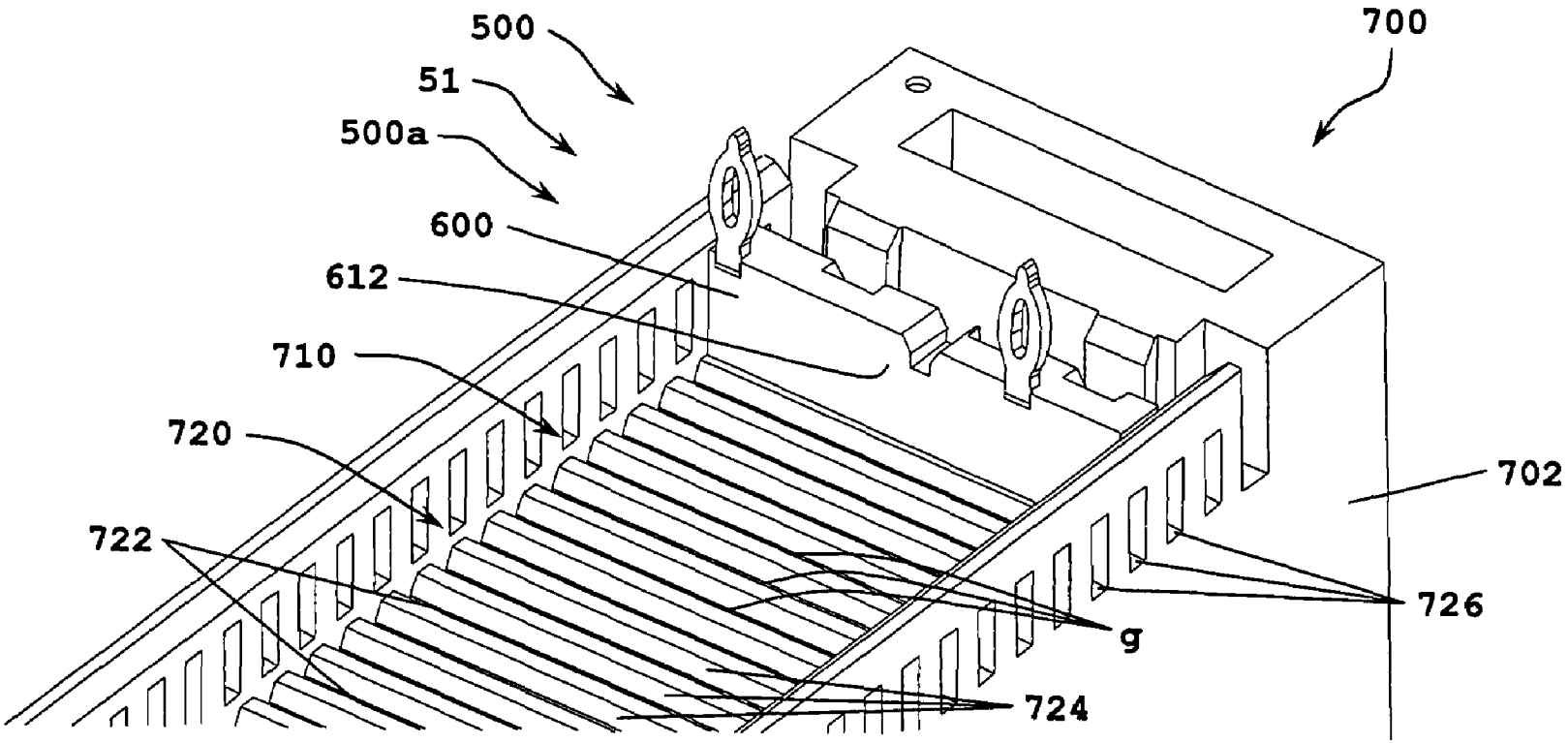
FIG. 11 is a perspective view of the first signal contact assembly of FIG. 10 in a first orientation following insertion into an electrical connector assembly according to an alternate embodiment of the present disclosure.
Figure 12:
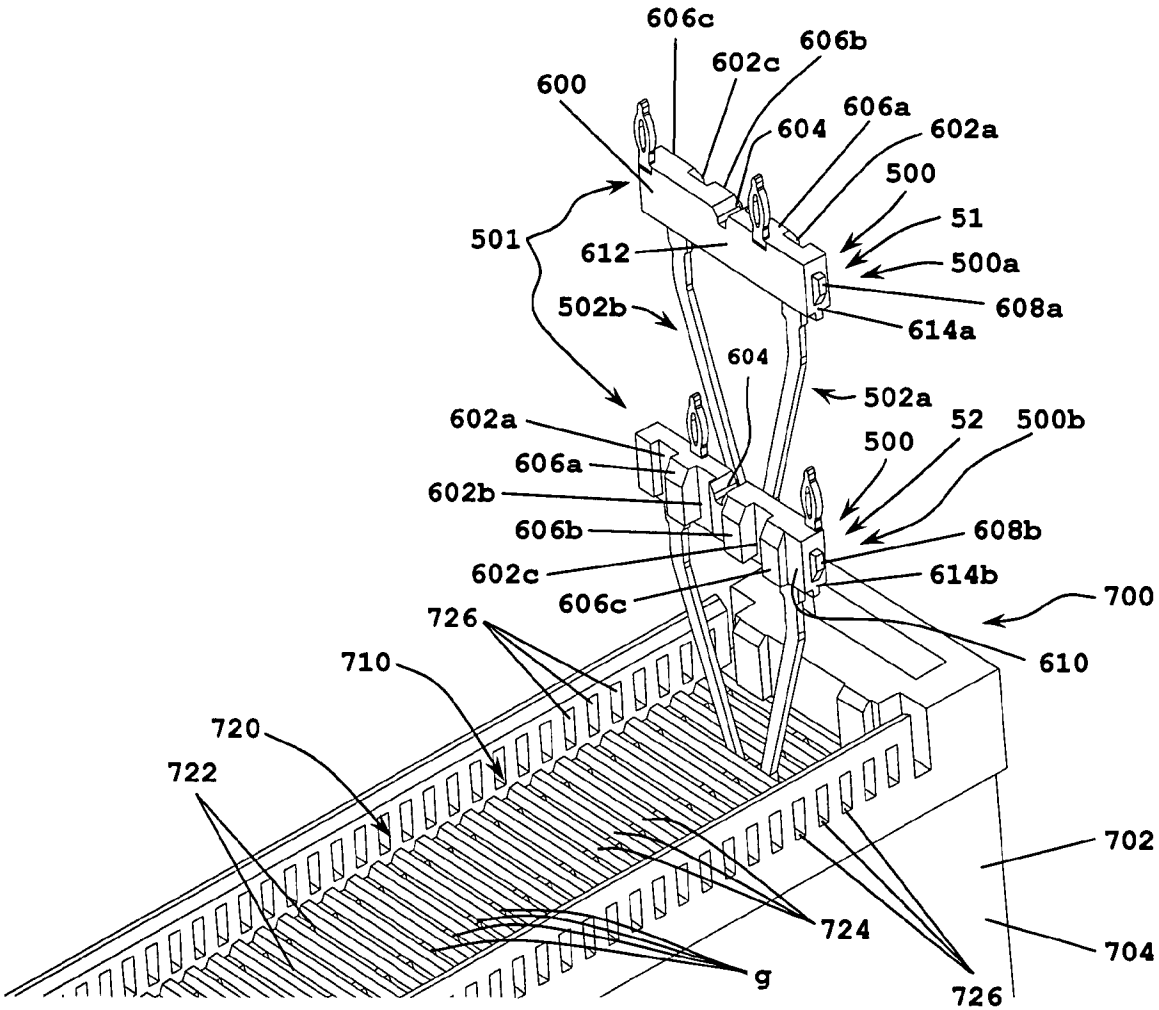
FIG. 12 is a perspective view of a first set of signal contact assemblies partially inserted into an electrical connector assembly according to an alternate embodiment of the present disclosure.
Figure 13:
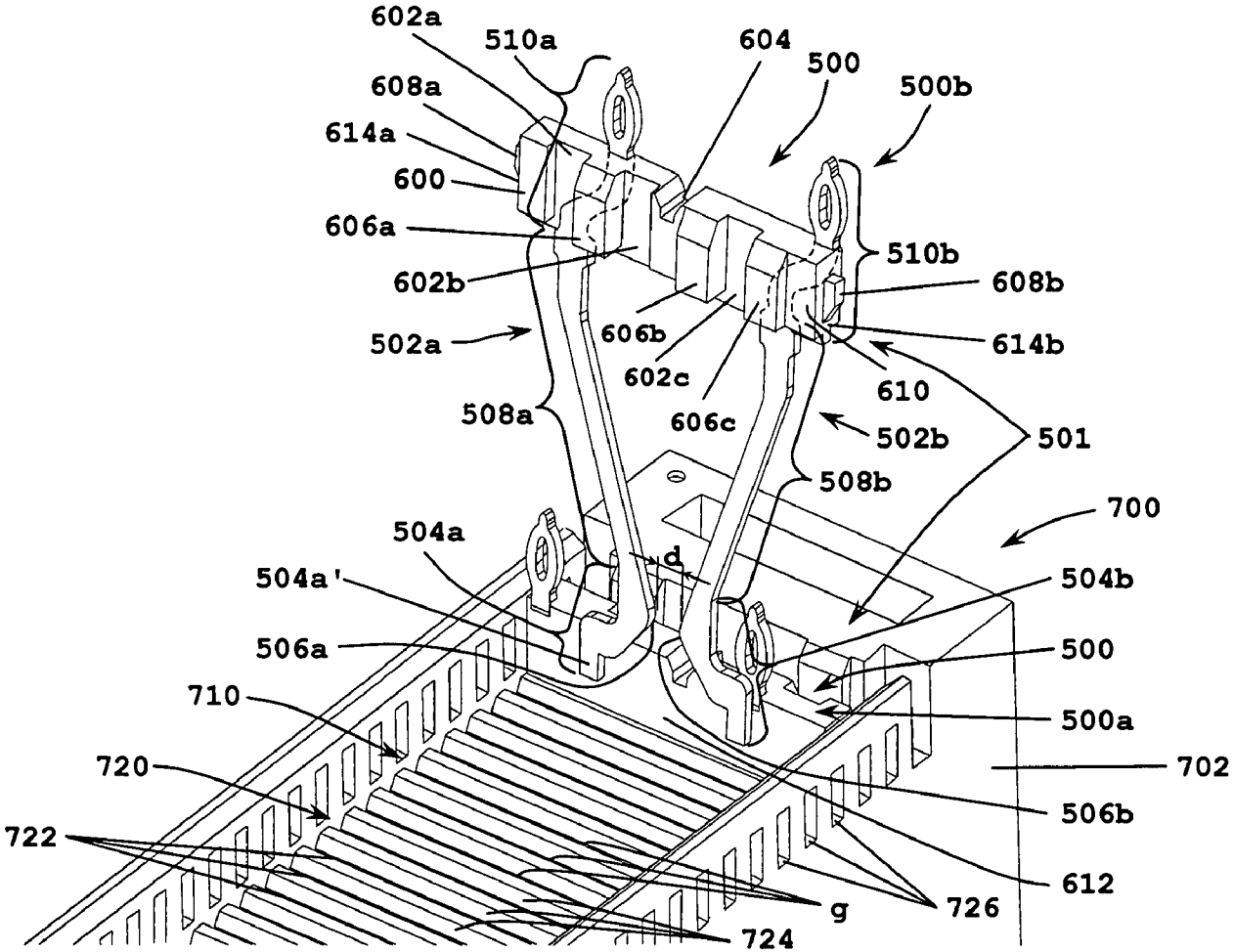
FIG. 13 is a perspective view of the first set of signal contact assemblies of FIG. 12 with the first signal contact assembly in the first orientation inserted into the electrical connector assembly and the second electrical contact assembly prior to insertion into the electrical connector assembly.

Referring to FIGS. 10-16, a plurality of sets 501 (see FIGS. 12-16) of substantially identical signal contact assemblies according to an embodiment of the present disclosure are generally designated as 500. Each set 501 of chicklets, as commonly referred to in the art, or signal contact assemblies 500 includes, as best shown in FIG. 10, a first signal contact 502*a* and a second signal contact 502*b* forming a first pair 51 of signal contacts such that the first pair 51 of signal contacts 502*a* and 502*b* is arranged in a first orientation 500*a*. As best shown in FIGS. 12 and 13, each set 501 of substantially identical signal contact assemblies 500 further includes a second pair 52 also having first signal contact 502*a* and second signal contact 502*b*. The second pair 52 is arranged in a second orientation 500*b*. As illustrated in FIGS. 10 and 12, the first pair 51 is arranged as a mirror image of the second pair 52. More particularly, the first pair 51 and the second pair 52 are rotated 180 degrees with respect to each other so that the orientation 500*b* of the second pair 52 is a reverse orientation with respect to the orientation 500*a* of the first pair 51.

The first and second signal contacts 502*a* and 502*b* each include an edge connector portion 504*a*, 504*b* having a contact surface 506*a*, 506*b*, respectively. The edge connector portion 504*a*, 504*b* is similar to the edge connector portion 104*a*, 104*b* of the electrical contact assembly 102*a*, 102*b* (see FIG. 1) except that the edge connector portion 504*a*, 504*b* includes a generally inverted L-shaped appendage 504*a*', 504*b*'. The signal contact assemblies 500 are configured such that a distance "d" representing the horizontal distance between the first and second signal contacts 502*a* and 502*b*, respectively, is a minimum at the contact surfaces 506*a* and 506*b*.

The first and second signal contacts 502*a*, 502*b* each include a contact tail portion 510*a*, 510*b*, respectively. The contact tail portion 510*a*, 510*b* is in electrical communication with the edge connector portion 504*a*, 504*b*, respectively. The first and second signal contacts 502*a*, 502*b* may each include a contact beam portion 508*a*, 508*b* which may be predominantly linear and which extends from the edge connector portion 504*a*, 504*b* to the contact tail portion 510*a*, 510*b*, respectively. A manufacturing cut-off region 514*a*, 514*b* may be included within the contact beam portion 508*a*, 508*b*, respectively. The contact beam portion 508*a*, 508*b* is in electrical communication with the edge connector portion 504*a*, 504*b* and with the contact tail portion 510*a*, 510*b*, respectively.

The contact tail portions 510*a*, 510*b* are illustrated in FIGS. 10 and 13 as compliant or press fit tail portions each of which has an aperture 512*a*, 512*b* disposed therethrough, respectively, which is compressed during insertion into a receptacle (not shown) of a printed circuit board (PCB) or other electrical device to establish electrical continuity with the PCB or other electrical device. Alternatively, the contact tail portions 510*a*, 510*b* may be formed as card edge contacts or pin or post contacts, or the like. The embodiments are not limited in this context.

The edge connector portion 504*a* of the first signal contact 502*a* is substantially a mirror image of the edge connector portion 504*b* of the second signal contact 502*b*. Similarly, the contact beam portion 508*a* of the first signal contact 502*a* is substantially a mirror image of the contact beam portion 508*b* of the second signal contact 502*b*. However, the contact tail portion 510*a* of the first signal contact 502*a* is substantially a slide-along image of the contact tail portion 510*b* of the second signal contact 502*b*.

In a similar manner to electrical contacts 102*a* and 102*b* described previously, the first and second signal contacts 502*a* and 502*b*, respectively, are made from an electrically conductive material, e.g., copper or a copper alloy. The embodiments are not limited in this context.

The signal contact assembly 500 further includes an insulative carrier 600 joining the first signal contact 502*a* to the second signal contact 502*b* such that the contact tail portion

510*a* of the first signal contact 502*a* is oriented substantially as a slide-along image of the contact tail portion 510*b* of the second signal contact 502*b*.

In one embodiment, the carrier 600 holds the contact beam portion 508*a* of the first signal contact 502*a* and the contact beam portion 508*b* of the second signal contact 502*b* such that the contact tail portion 510*a* of the first signal contact 502*a* is oriented substantially as a slide-along image of the contact tail portion 510*b* of the second signal contact 502*b*. In a similar manner as the carrier 200 (see FIG. 2), the carrier 600 may be a structural member such as an overmolding which may be made from an electrically insulating material such as a plastic, and which provides electrical insulation between the first and second signal contacts 502*a* and 502*b*, respectively. The embodiments are not limited in this context.

The carrier 600 is configured such that the contact tail portions 510*a*, 510*b* are exposed thereby.

In one embodiment, the carrier 600 may further include a recess 604 for receiving an offset tail of a ground contact as discussed below. In addition, as best shown in FIGS. 12 and 13, the carrier 600 has a first surface 610 and a substantially flat second surface 612 and may further include at least one castellation or protruding ridge 606*a*, and typically at least three castellations or protruding ridges 606*a*, 606*b* and 606*c*, each formed so as to protrude from the first surface 610. The first or at least one protruding ridge 606*a* may be flanked by two adjacent channels or recesses 602*a* and 602*b* formed in the first surface 610.

Correspondingly, a third channel 602*c*, also may be formed in the first surface 610 and may be flanked by the adjacent second and third of the at least one protruding ridge 606*b* and 606*c*.

The carrier 600 may be configured to include first and second signal contact assembly support protrusions 608*a* and 608*b*, respectively. The first and second support protrusions 608*a* and 608*b*, respectively, may be disposed on opposite ends 614*a* and 614*b* of the carrier 600 to protrude transversely from the first and second surfaces 610 and 612, respectively.

As also illustrated in FIGS. 10-16, the present disclosure relates also to an electrical connector or electrical connector assembly 700 including a housing 702 which may include two parallel walls 704. The housing 702 includes first aperture 710 providing accessibility to an array 720 of partitioned electrically insulating adjacent compartments 722. The compartments 722 may be formed by a plurality of substantially parallel cross-members or cross-beams 724 which are spaced apart by a gap "g" therebetween. In addition, the housing 702 may include a plurality of apertures or windows 726 which are disposed in the two parallel walls 704 in the vicinity of the first aperture 710. The housing 702 is configured to receive at least one set 501 of the substantially identical signal contact assemblies 500 via the array 720 of partitioned electrically insulating adjacent compartments 722. The compartments 722 of the array 720 are configured to expose the contact tail portions 510*a*, 510*b* of the first and second signal contacts 502*a*, 502*b* at the first aperture 710. More particularly, edge connector portions 504*a* and 504*b* of the sets 501 are inserted through the gap "g" between the substantially parallel cross-beams 724. The first and second support protrusions 608*a* and 608*b*, respectively, disposed on opposite ends 614*a* and 614*b* of the carrier 600 are snap fitted into position each one into one of the windows 726 disposed in the two parallel walls 704 of the housing 702.

Figure 14:
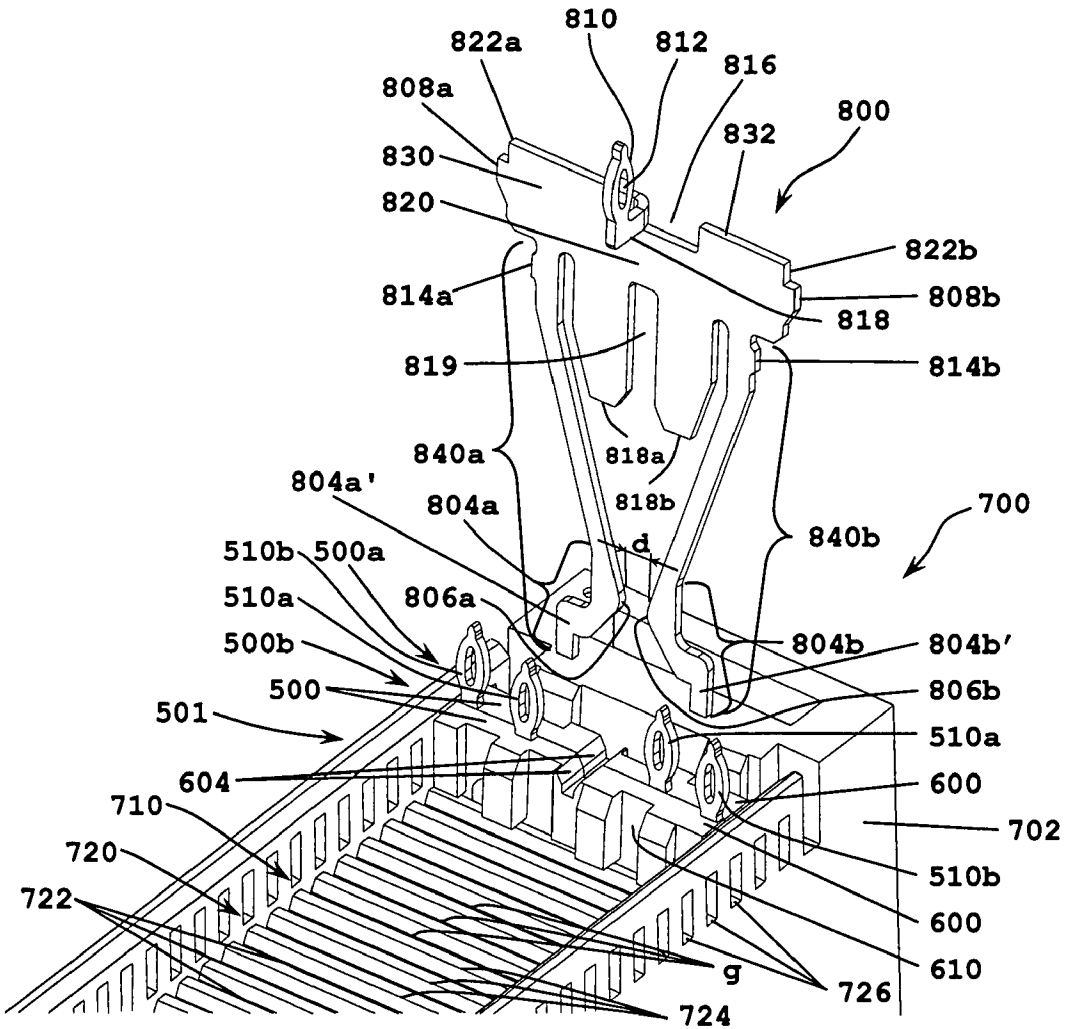
FIG. 14 is a perspective view of a ground contact being inserted into the electrical connector assembly of FIGS. 10, 11, 12 and 13.

As best illustrated in FIG. 14, as previously referred to, each signal contact assembly 500 includes a recess 604 in the carrier 600 for receiving an offset tail of a ground contact. As best shown in FIGS. 12 and 13, the set 501 of signal contact assemblies 500 is inserted into compartments 722 such that the second surface 612 of the contact assembly 500 which is in the first orientation 500*a* is in opposing relationship to the second surface 612 of the contact assembly 500 which is in the second orientation 500*b*. The recess 604 is disposed centrally in the carrier 600 such that when the set 501 of signal contact assemblies 500 is inserted into compartments 722, the recess 604 of the contact assembly 500 which is in the first orientation 500*a* is substantially aligned with the recess 604 of the contact assembly 500 which is in the second orientation 500*b* and such that the recesses 604 are accessible through the aperture 710 of the housing 702.

In one embodiment, as best shown in FIG. 14, the electrical connector assembly 700 may further include at least one ground contact 800 having a planar main body 820 with a substantially flat or planar first surface 830. The ground contact 800 is similar to the signal contact assembly 500 in that the ground contact 800 includes first and second ground contact beams 840*a* and 840*b*, respectively, partially forming the surface 830. The first and second ground contact beams 840*a* and 840*b* extend from the main body 820, and in the plane of the main body 820. The first and second ground contact beams 840*a* and 840*b* include edge connector portions 804*a* and 804*b* which are disposed distally from the main body 820 to form ends of the ground contact beams 840*a* and 840*b*, respectively. The second ground contact beam 840*b* is substantially a mirror image of the first ground contact beam 840*a*. The edge connector portions 804*a* and 804*b* may include contact surfaces 806*a* and 806*b*, respectively. The ground contacts 800 are configured such that a distance "d" representing the horizontal distance between the first and second ground contact beams 840*a* and 840*b*, respectively, is a minimum at the contact surfaces 806*a* and 806*b*. A manufacturing cut-off region 814*a*, 814*b* may be included within the contact beams 840*a*, 840*b*, respectively.

The ground contact 800 also includes, extending from the main body 820, first and second prongs 818*a* and 818*b*, respectively, in the plane of the main body 820 which are separately disposed to form an open-ended aperture 819 between the first and second prongs 818*a* and 818*b*, respectively. The open-ended aperture 819 is configured to engage with a ridge or saddle (not shown) within the compartments 722 so as to enable alignment of the ground contacts 800 with the signal contact assemblies 500 when inserted within the compartments 722.

In addition, the ground contact 800 includes a contact tail portion 810 formed on an edge 832 of the main body 820. The contact tail portion 810 may be cut and bent to be further disposed at an angle, e.g., substantially orthogonally, to the plane of the main body 820. The cutting and bending of the contact tail portion 810 forms a recess or channel 816 in the main body 820 near the edge 832.

The contact tail portion 810 is in electrical communication with the first and second ground contact beams 840*a* and 840*b*, respectively, such that the contact tail portion 810 is a contact tail portion in common electrical communication with the first and second ground contact beams 840*a* and 840*b*, respectively, via the main body 820.

The common contact tail portion 810 is illustrated in FIG. 14 as a compliant or press fit tail portion having an aperture 812 disposed therethrough, which is compressed during insertion into a receptacle (not shown) of a printed circuit board (PCB) or other electrical device to establish electrical continuity with the PCB or other electrical device. Alternatively, the contact tail portion 810 may be formed as a card edge contact or a pin or a post contact, or the like. The embodiments are not limited in this context. In addition, the cutting and bending of the contact tail portion 810 also forms a surface 818 which forms a signal contact assembly mating portion, as is explained in more detail below.

The main body 820 may be configured to include first and second ground contact assembly support protrusions 808*a* and 808*b*, respectively. The first and second support protrusions 808*a* and 808*b*, respectively, may be disposed on opposite ends 822*a* and 822*b* of the main body 820 to protrude transversely from the first surface 830.

In that, as noted previously, the second ground contact beam 840*b* is substantially a mirror image of the first ground contact beam 840*a*, the edge connector portion 804*a* of the first ground contact beam 840*a* is substantially a mirror image of the edge connector portion 804*b* of the second ground contact beam 840*b*. In addition, the first prong 818*a* is substantially a mirror image of the second prong 818*b*.

The ground contact 800 is made from an electrically conductive material, e.g., copper or a copper alloy. The embodiments are not limited in this context.

As illustrated particularly in FIGS. 14-18, each ground contact 800 is inserted through the aperture 710 of the housing 702 into one of the plurality of partitioned electrically insulating compartments 722 such that the main body of the ground contact 800 is disposed between the ridges 606*a*, 606*b*, 606*c* of two opposed signal contact assemblies 500 which are in two different sets 501. The main body 820 is received with a relatively close fit between the ridges 606*a*, 606*b*, 606*c* of the two opposed signal contact assemblies 500 such that the main body is closely supported and stabilized by the contact assemblies. The surface 818 of the ground contact offset tail portion 810 resides in both the recess 604 of the contact assembly 500 which is in the first orientation 500*a* and in the recess 604 of the contact assembly 500 which is in the second orientation 500*b*, the recesses 604 being substantially aligned to establish or maintain electrical insulation between the ground contact 800 and the corresponding set 501 of signal contact assemblies 500. Therefore, the ground contact offset tail portion 810 is partially disposed in the aligned recesses 604.

More particularly, in a similar manner as for the signal contact assemblies 500, edge connector portions 804*a* and 804*b* of the ground contact 800 are inserted through the gap "g" between the substantially parallel cross-beams 724. The first and second support protrusions 808*a* and 808*b*, respectively, disposed on opposite ends 822*a* and 822*b* of the main body 820 are snap fitted into position each one into one of the windows 726 disposed in the two parallel walls 704 of the housing 702.

The plurality of signal contact assemblies 500 are arranged in the sets 501 in sequence in a linear array such that the electrical contacts 502*a*, 502*b* of the plurality of contact assemblies 500 are arranged in the second orientation 500*b* which is a reverse orientation with respect to the first orientation 500*a* of an immediately preceding contact assembly 500 so as to expose the contact tail portions 510*a*, 510*b* of the electrical contact assemblies 500 in a staggered configuration with respect to the contact tail portions 510*b*, 510*a* of the immediately preceding contact assembly, respectively.

Figure 15:
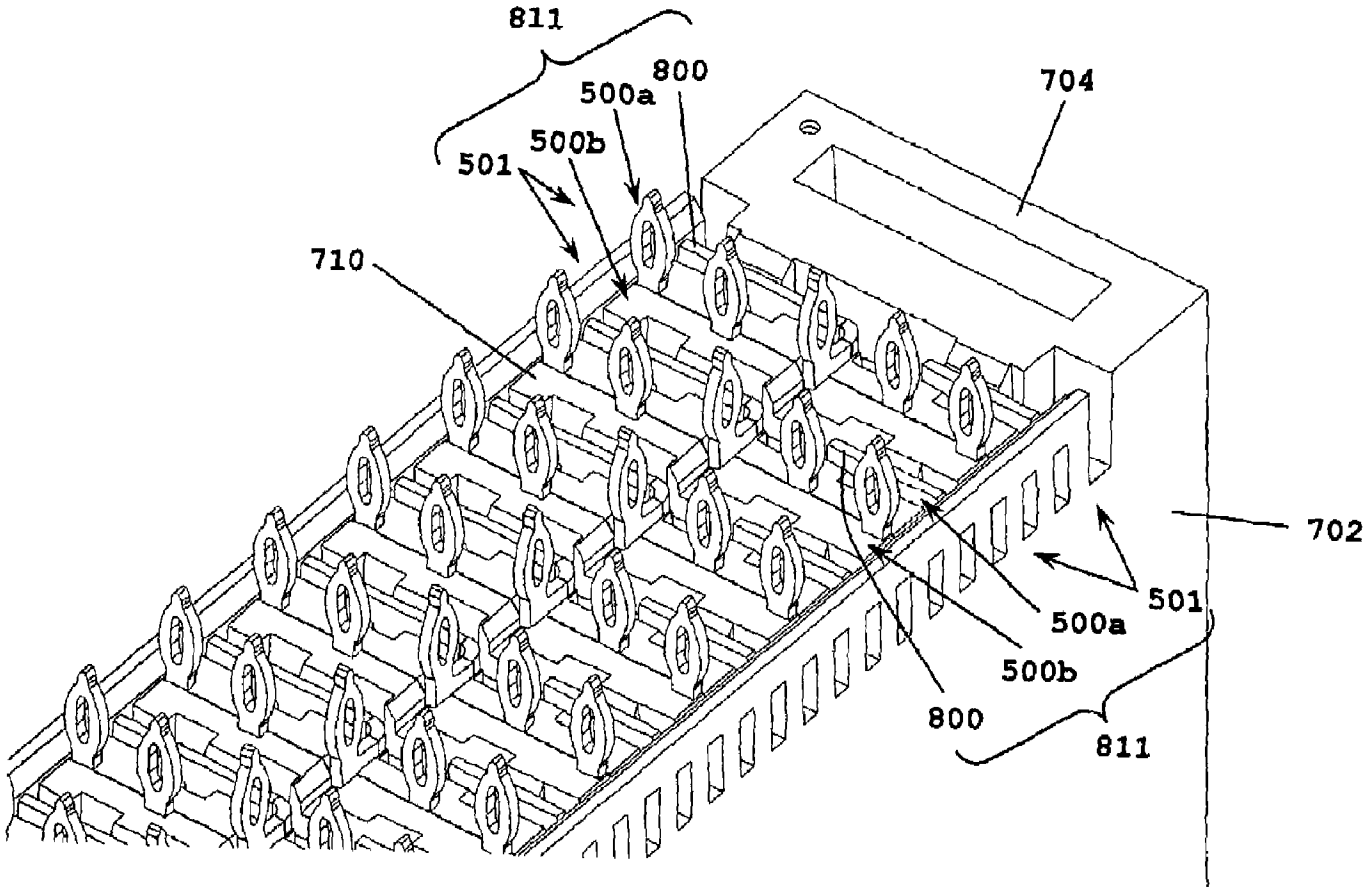
FIG. 15 is a perspective view of multiple sets of signal contact assemblies and the ground contacts following insertion into a first portion of the electrical connector assembly of FIGS. 10-14.

Thereby, as shown in FIG. 15 by way of example, a first portion 704 of the housing 702 of the electrical connector assembly 700 is configured via the array 720 of compartments 722 to receive a plurality of sets 811 of a ground contact 800 and a set 501 of signal contact assemblies 500. The set 501 is formed of at least one signal contact assembly 500 in a first orientation 500*a* and one signal contact assembly 500 in a second orientation 500*b*, to provide a signal-signal-ground (S-S-G) pattern. The sets 501 may be received in pairs of compartments 722 in the array 720.

Figure 16:
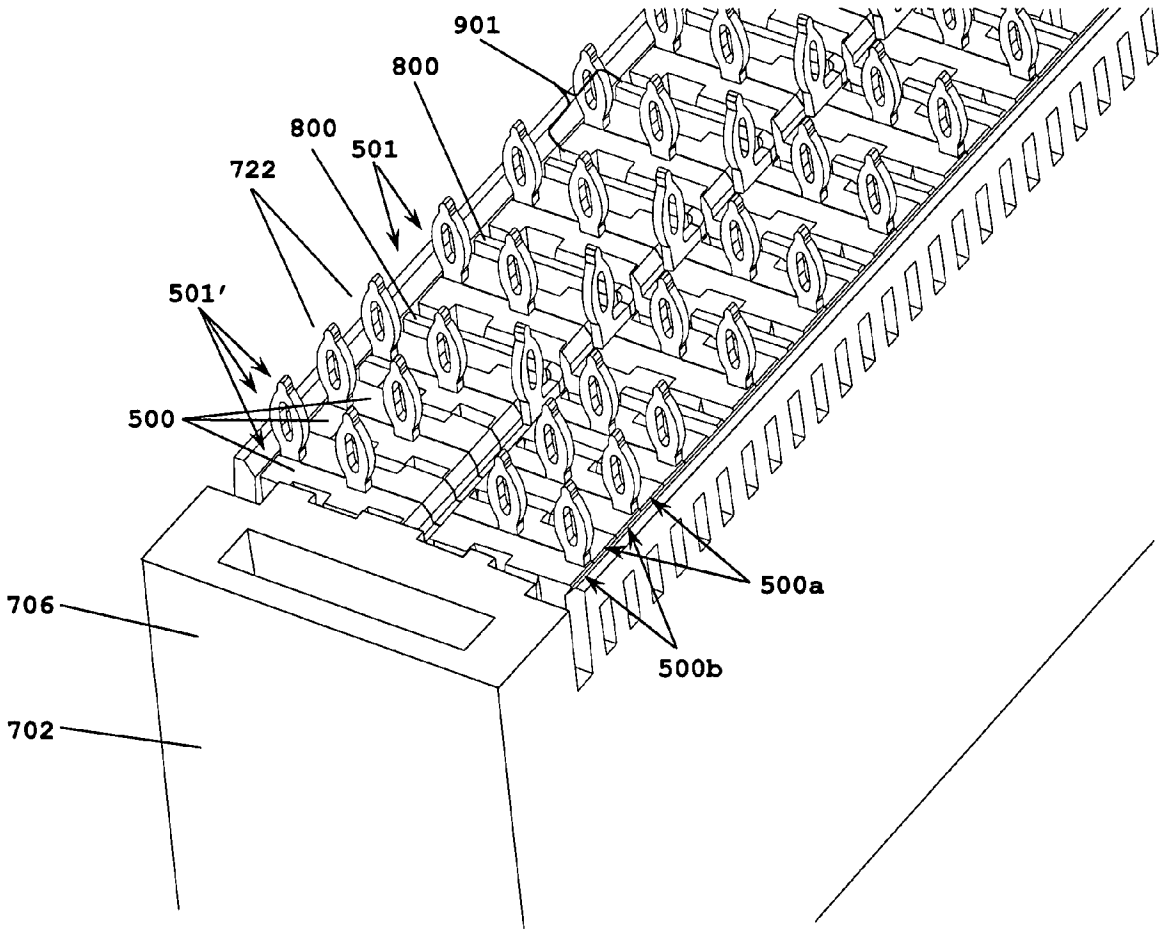
FIG. 16 is a perspective view of the multiple sets of signal contact assemblies and the ground contacts following insertion into a second portion of the electrical connector assembly of FIGS. 10-14.
Figure 17:
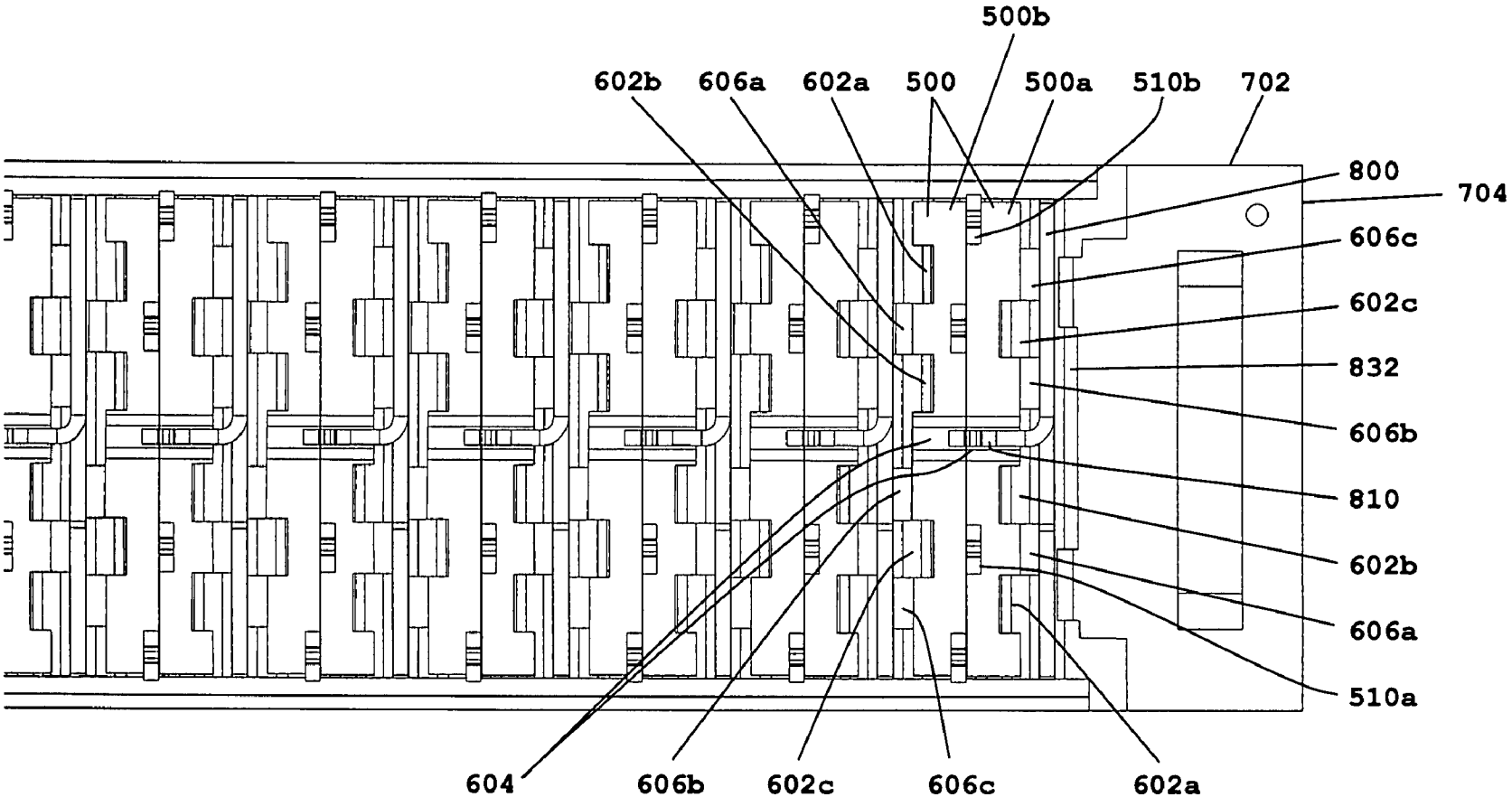
FIG. 17 is a plan view of the multiple sets of signal contact assemblies and the ground contacts following insertion into the first portion of the electrical connector assembly of FIG. 15.
Figure 18:
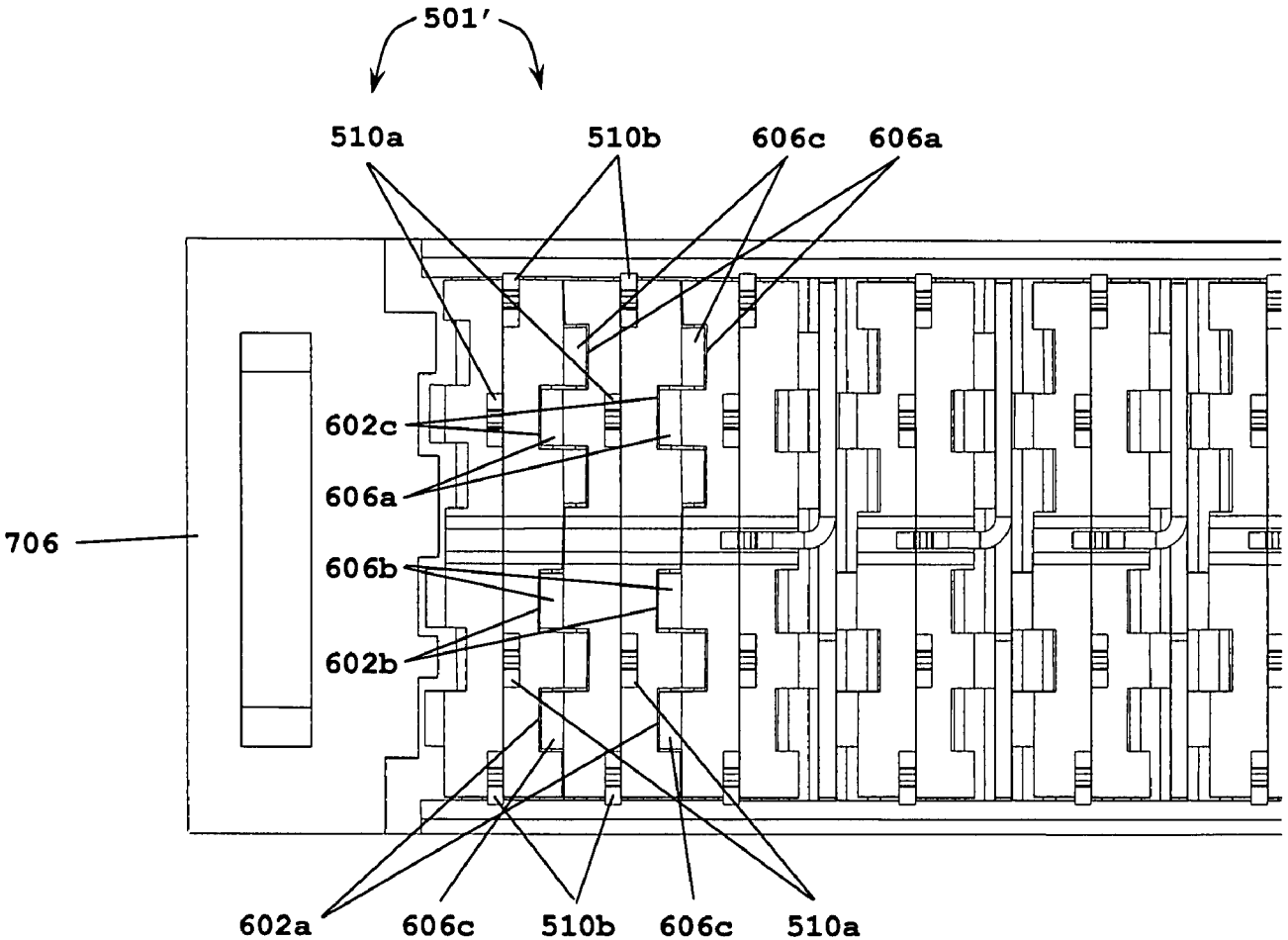
FIG. 18 is a plan view of the multiple sets of signal contact assemblies and the ground contacts following insertion into the second portion of the electrical connector assembly of FIG. 16.

Alternatively, referring to FIG. 16, as illustrated by sets 501' of signal contact assemblies 500 inserted into a second portion 706 of the array 720 of partitioned compartments 722, the ground contact 800 may be omitted so as to provide only a signal-signal (S-S) pattern. In this configuration, as best shown in FIG. 18, the sets 501' of the signal contact assemblies 500 are disposed in the portion 706 of the housing 702 such that the protruding ridges 606*a*, 606*b* and 606*c* of at least one of the contact assemblies 500 in the second orientation 500*b* engage with and are received by the recesses 602*c*, 602*b* and 602*a*, respectively.

Therefore, since a signal contact assembly 500 of the set 501' oriented in the first orientation 500*a* includes at least one recess 602*a*, 602*b* and/or 602*c* and at least one protruding ridge 606*a*, 606*b* and/or 606*c*, the at least one recess 602*a*, 602*b* and/or 602*c* being disposed on the signal contact assembly 500 enables reception of at least one protruding ridge 606*c*, 606*b* and/or 606*a*, respectively, of a substantially identical signal contact assembly 500 in a second orientation 500*b*, and the at least one protruding ridge 606*c*, 606*b* and/or 606*a* being disposed on the signal contact assembly 500 in the first orientation 500*a* enables engagement with at least one recess 602*a*, 602*b* and/or 602*c* disposed on the substantially identical signal contact assembly 500 in the second orientation 500*b*.

Figure 19:
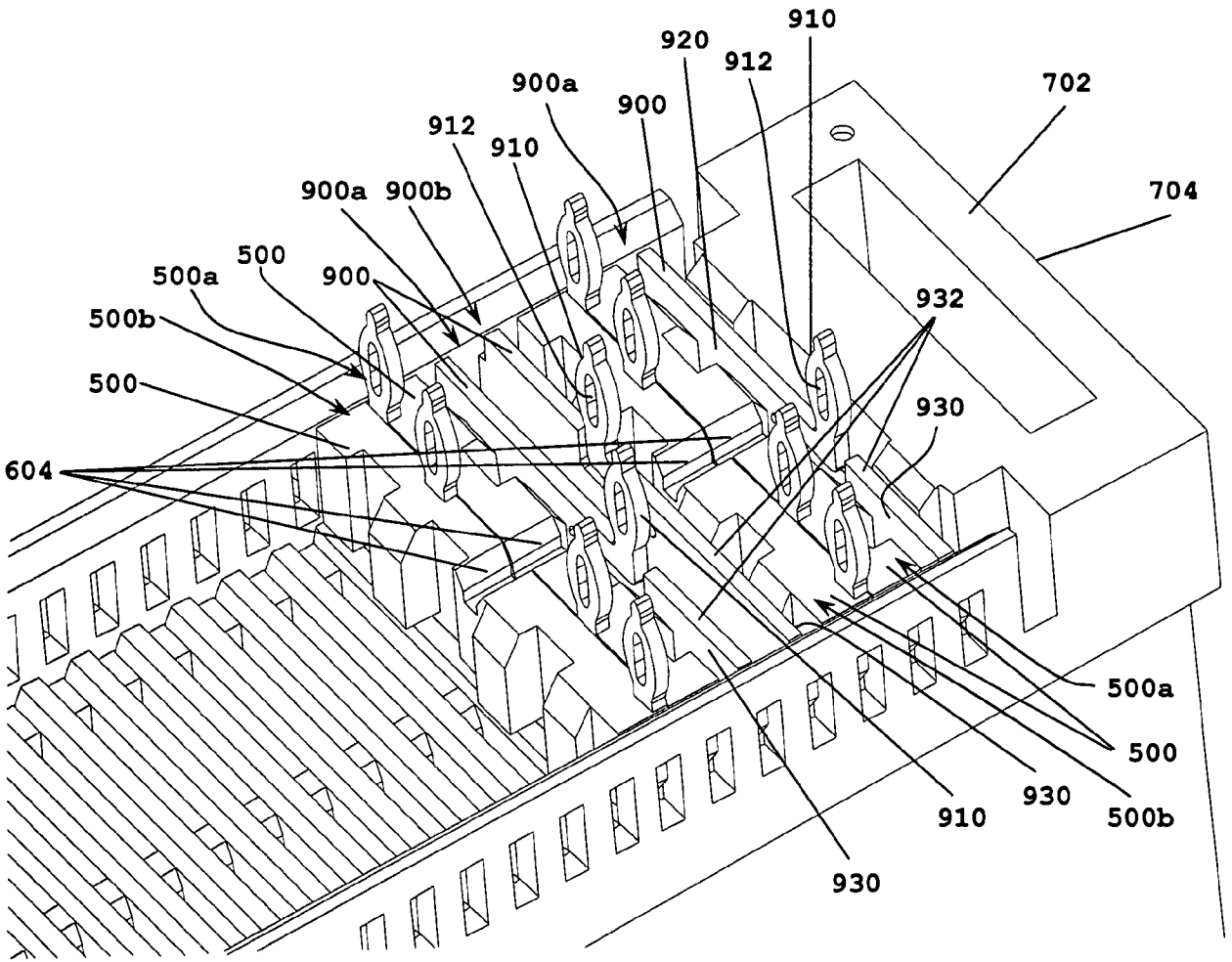
FIG. 19 is a perspective view of the multiple sets of signal contact assemblies with alternate ground contacts.
Figure 20:
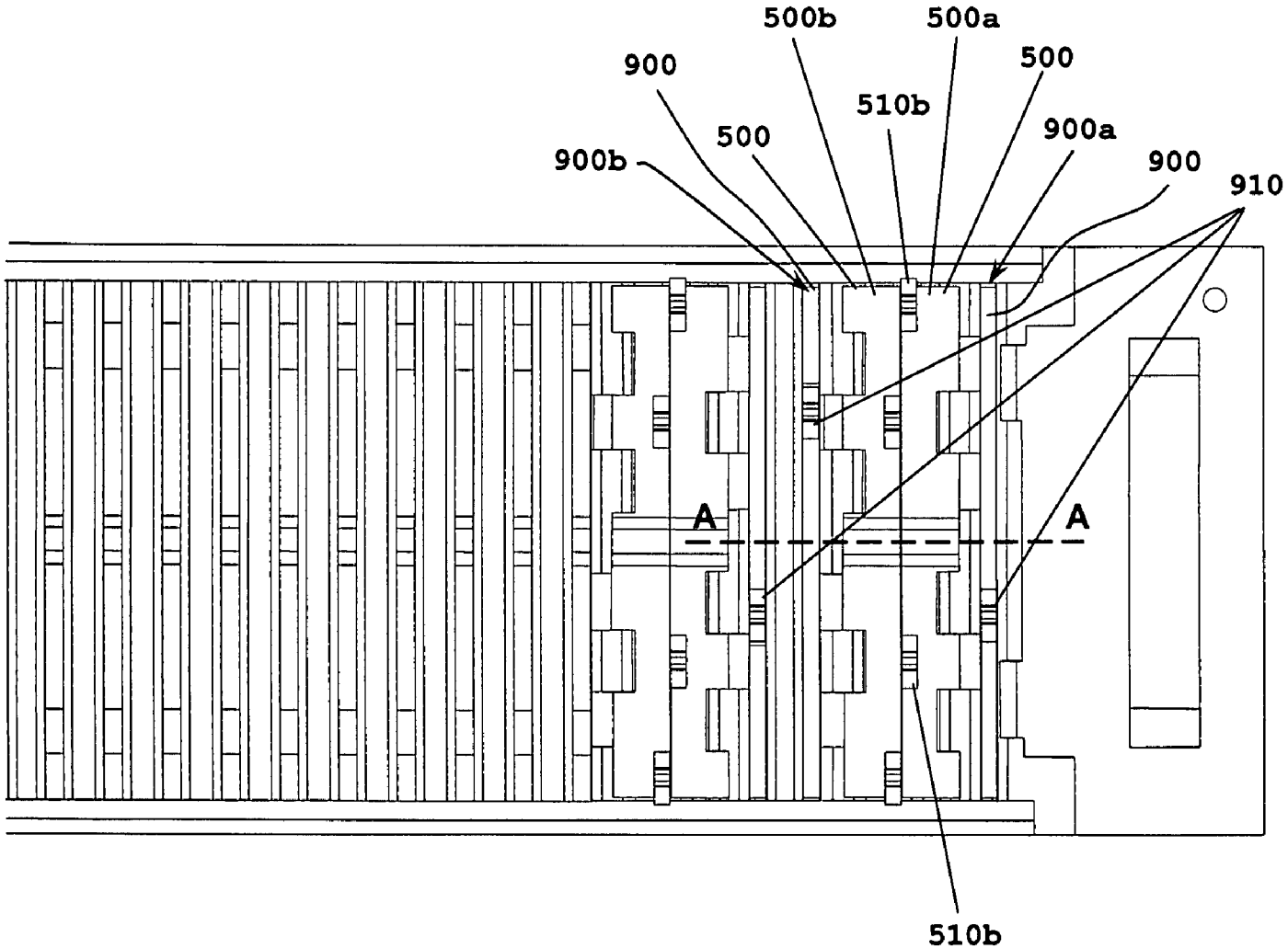
FIG. 20 is a plan view of the multiple sets of signal contact assemblies with alternate ground contacts according to FIG. 19.

FIGS. 19 and 20 illustrate an alternate ground contact 900 which, together with sets 501 of signal contact assemblies 500, is inserted into the array 720 of compartments 722 in the first portion 704 of the housing 702. In a similar manner to ground contact 800, as discussed previously with respect to FIG. 14, the ground contact 900 includes a contact tail portion 910 formed on an edge 932 of a main body 920 and having a first surface 930. However, instead of the contact tail portion 910 being bent to be further disposed at an angle to first surface 930 of the main body 920, the contact tail portion 910 is disposed in the plane of the main body 920 and is offset from the central axis A-A of the ground contact 900 (see FIG. 20). The offset of the contact tail portion 910 permits the ground contact 900 to be inserted into the compartments 722 in an alternating sequence of a first orientation 900*a* and of a second orientation 900*b* which is reverse to the first orientation 900*a*. The alternating sequence of the first and second orientations 900*a* and 900*b* therefore enables the contact tail portions 910 to assume a staggered configuration.

The contact tail portion 910 is also in electrical communication with the first and second ground contact portions (not shown) that are essentially identical to first and second ground contact portions 840*a* and 840*b*, respectively, (see FIG. 14), such that the contact tail portion 910 is a contact tail portion in common electrical communication with the first and second ground contact portions via the main body 920.

Again, the common contact tail portion 910 is illustrated in FIGS. 19 and 20 as a compliant or press fit tail portion having an aperture 912 disposed therethrough, which is compressed during insertion into a receptacle (not shown) of a printed circuit board (PCB) or other electrical device to establish electrical continuity with the PCB or other electrical device. Alternatively, the contact tail portion 910 may be formed as a card edge contact or a pin or a post contact, or the like. The embodiments are not limited in this context. The ground contact 900 is made from an electrically conductive material, e.g., copper or a copper alloy. The embodiments are not limited in this context.

Although the contact tail portion 910 may be partially cut from the main body 920, the contact tail portion 910 is not bent away from the first surface 930 but instead is substantially co-planar with the main body 920. As a result, the ground contact 900 may be easily converted into the ground contact 800 by the single step of bending the contact tail portion 910 away from the first surface 930, thereby providing additional manufacturing flexibility.

As illustrated in FIGS. 19-20, each ground contact 900 is inserted through the aperture 710 of the housing 702 into one of the plurality of partitioned electrically insulating compartments 722 such that the first surface 930 of the ground contact 900 is in opposing relationship with the ridges 606*a*, 606*b*, 606*c* on the first surface 610 of the electrical contact assembly 500 of a corresponding set 501 in the first orientation 500*a* and in the second orientation 500*b*. However, since the contact tail portion 910 is disposed in the plane of the ground contact 900, the contact tail portion 910 does not reside in either the recess 604 of the contact assembly 500 which is in the first orientation 500*a* or in the recess 604 of the contact assembly 500 which is in the second orientation 500*b*.

The staggered configuration of one ground contact 900 being in a first orientation 900*a* and one ground contact 900 being in a second orientation 900*b* provides a signal-signal-ground-ground (S-S-G-G) pattern.

The surfaces 820 of the ground contacts 800 fit closely between the castellations or protruding ridges 606*a*, 606*b* and 606*c* of the signal contact assemblies 500 so that a stabilizing effect is provided to at least partially counteract potential movement of the signal contact assemblies 500 and the ground contacts 800 due to the spatial tolerance of the gap "g" between the substantially parallel cross-beams 724 forming the compartments 722.

In view of the foregoing, it can be appreciated that the same, i.e., substantially identical, signal contact assembly 500 having the protruding ridges 606*a*, 606*b*, 606*c* and recesses 602*a*, 602*b* 602*c*, may be used either in conjunction with ground contact 800 or with ground contact 900, or without any ground contact, to permit a signal-signal-ground (S-S-G) pattern or a signal-signal-ground-ground (S-S-G-G) pattern, or a signal-signal (S-S) pattern.

In addition, the electrical connector assembly 700 includes the housing 702 having the array 720 of compartments 722 which hold the signal contact assemblies 500. The signal contact assemblies 500 are arranged in sets 501 wherein each set includes a pair 51 or 52 of identical signal contacts 502*a* and 502*b* which are arranged in opposite first and second orientations 500*a* and 500*b*, respectively. A plurality of identical ground contacts 800 or 900 may be selectively arranged and installed in the compartments 722 between the pairs 51 and 52 of identical signal contacts 502*a* and 502*b* between each of the sets 501. More particularly, one ground contact 800 may be installed between each of the sets 501 to form a signal-signal-ground pattern. Each of the signal contact assemblies 500 includes an insulative carrier, e.g., insulative carrier 600, and each of the ground contacts 800 may be closely supported by the insulative carrier of an adjacent signal contact assembly 500. Since the signal contact assemblies 500 includes the insulative carrier 600 having a recess 604, and each of the ground contacts 800 has an offset tail portion 810 that is disposed in a respective recess 604.

Alternatively, two ground contacts 900 may be installed between each of the sets 501 to form a signal-signal-ground-ground pattern. Since each of the signal contact assemblies 500 includes insulative carrier 600, each of the ground contacts 900 may be closely supported between the insulative carriers of two opposed signal contact assemblies 500 in two different sets 501.

Therefore, the signal contact assembly 500 significantly reduces overall manufacturing and inventory costs In addition, the recesses 604 of the main body 600 of the signal contact assembly 500 enable the contact tail portion 810 of ground contact 800 to reside in the recesses 604 to provide additional flexibility in arrangement of the electrical connector assembly 700.

As can be appreciated from the foregoing disclosure, the embodiments of the present disclosure provide an electrical contact assembly which can be inserted in numerous quantities into an electrical connector, both of which are configured to reduce manufacturing and assembly costs. The disposition of the contact tail portions in a staggered configuration enables a savings in space for electrically communicating or mating to an electrical device which is intended to receive the contact tail portions.

The described embodiments of the present disclosure are intended to be illustrative rather than restrictive, and are not intended to represent every embodiment of the present disclosure. Various modifications and variations can be made without departing from the spirit or scope of the disclosure as set forth in the following claims both literally and in equivalents recognized in law.

What is claimed is:

1. An electrical connector assembly comprising:

a housing having at least two substantially identical signal contact assemblies, the contact assemblies including:

a first signal contact assembly in a first orientation comprising:

at least one recess formed within the first signal contact assembly; and at least one protruding ridge extending from the first signal contact assembly; and a second signal contact assembly in a second orientation which is opposite to the first orientation, the second signal contact assembly comprising:

at least one recess formed within the second signal contact assembly; and at least one protruding ridge extending from the second signal contact assembly;

wherein the at least one recess of the first signal contact assembly in the first orientation is disposed on the first signal contact assembly in the first orientation to enable reception of the at least one protruding ridge of the substantially identical second signal contact assembly in the second orientation, and wherein the at least one protruding ridge of the first signal contact assembly in the first orientation is disposed on the first signal contact assembly in the first orientation to enable engagement with the at least one recess disposed on the substantially identical second signal contact assembly in the second orientation.

2. The electrical connector assembly according to claim 1, wherein the housing further comprises:

at least one ground contact disposed between the first signal contact assembly in the first orientation and the second signal contact assembly in the second orientation.

3. The electrical connector assembly according to claim 2, wherein both the first signal contact assembly in the first orientation and the second signal contact assembly in the second orientation further comprise:

a first signal contact having:

an edge connector portion; and a contact tail portion in electrical communication with the edge connector portion, a second signal contact having:

an edge connector portion; and a contact tail portion in electrical communication with the edge connector portion; and a carrier holding the first signal contact and the second signal contact, the carrier having the at least one recess and the at least one protruding ridge.

4. The electrical connector assembly according to claim 3, wherein the edge connector portion of the first signal contact is substantially a mirror image of the edge connector portion of the second signal contact, and wherein the contact tail portion of the first signal contact is substantially a slide-along image of the contact tail portion of the second signal contact.

5. The electrical connector assembly according to claim 3, wherein the first and second signal contacts each comprise a contact beam portion extending from the edge connector portion, the contact beam portion providing the electrical communication between the edge connector portion and the contact tail portion.

6. The electrical connector assemblyaccording to claim 5, wherein the contact beam portion of the first signal contact is substantially a mirror image of the contact beam portion of the second signal contact.

* * * * *